US007036853B2

(12) United States Patent
Smock et al.

(10) Patent No.: US 7,036,853 B2
(45) Date of Patent: May 2, 2006

(54) MOTORIZED OVEN LOCK FOR SEALING OVEN DOOR

(75) Inventors: Steve W. Smock, Indianapolis, IN (US); Harry I. Courter, Indianapolis, IN (US); Greg Wright, Roscoe, IL (US); Tracy J. Talley, Indianapolis, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/730,296

(22) Filed: Dec. 8, 2003

(65) Prior Publication Data

US 2005/0121918 A1 Jun. 9, 2005

(51) Int. Cl.
*E05C 5/00* (2006.01)

(52) U.S. Cl. ..... 292/109; 292/110; 292/112; 292/194; 292/198; 292/201; 292/216; 292/332; 292/341.16; 292/341.17; 292/DIG. 69

(58) Field of Classification Search ..... 292/109, 292/110, 112, 194, 198, 199, 201, 203, 216, 292/280, 332, 333, 341.16, 341.17, DIG. 42, 292/DIG. 69
See application file for complete search history.

(56) References Cited

U.S. PATENT DOCUMENTS 1,309,310 A * 7/1919 Voight ..... 292/234
1,396,163 A * 11/1921 Cleal et al. ..... 70/98
1,578,537 A * 3/1926 Luce ..... 292/198
3,438,666 A 4/1969 Erickson
3,569,670 A 3/1971 Christian
3,646,612 A 2/1972 Anderson
3,750,643 A 8/1973 Fowler et al.
3,757,084 A * 9/1973 McLean et al. ..... 219/413
3,831,580 A 8/1974 McLean
3,859,979 A 1/1975 Gilliom
4,082,077 A 4/1978 Marfatia et al.
4,082,078 A 4/1978 Thuleen et al.
4,109,637 A 8/1978 Drouin
4,127,101 A 11/1978 Tilton
4,136,667 A 1/1979 Lewis
4,163,443 A 8/1979 Peterson
4,174,860 A * 11/1979 Shea ..... 292/113
4,201,901 A 5/1980 Schuchert
4,202,571 A * 5/1980 Nishikoori ..... 292/216
4,351,288 A * 9/1982 Gasloli ..... 126/197
4,374,320 A 2/1983 Barnett
4,434,635 A * 3/1984 Borgato ..... 70/279.1
4,593,945 A 6/1986 Arute et al.
4,746,153 A * 5/1988 Compeau et al. ..... 292/216
4,776,619 A * 10/1988 Daugherty et al. ..... 292/201
4,796,932 A * 1/1989 Tame ..... 292/112
4,838,586 A 6/1989 Henne
4,861,078 A 8/1989 Munoz
4,927,996 A 5/1990 Genbauffe et al.
4,968,073 A * 11/1990 Kuhlman ..... 292/201

(Continued)

*Primary Examiner*—Brian E. Glessner
*Assistant Examiner*—Carlos Lugo
(74) *Attorney, Agent, or Firm*—Maginot, Moore & Beck

(57) ABSTRACT

An oven lock mechanism has a latch that is moved between an unlatched and a latched position in response to movement of the door from an open to a closed position and a motor that turns a cam acting as a blocker to block the latch in the latched position when a cleaning cycle is initiated. The rotation of the cam also induces movement of the latch to cause the latch to pull the door in closer to the frame of the oven.

12 Claims, 19 Drawing Sheets

U.S. PATENT DOCUMENTS 4,982,063 A 1/1991 Tsunekawa et al.
5,004,276 A 4/1991 Hanley
5,029,910 A * 7/1991 Genbauffe et al. ..... 292/110
5,220,153 A 6/1993 Malone et al.
5,419,305 A 5/1995 Hanley
5,440,103 A * 8/1995 Martin ..... 219/413
5,477,030 A * 12/1995 Buckshaw et al. ..... 219/413
5,493,099 A 2/1996 McWilliams, III
5,595,409 A * 1/1997 Fier et al. ..... 292/112
6,079,756 A 6/2000 Phillips
6,302,098 B1 10/2001 Smith
6,315,336 B1 11/2001 Swartzell
6,474,702 B1 * 11/2002 Malone et al. ..... 292/97
6,698,418 B1 * 3/2004 Ramsey et al. ..... 126/197
6,709,029 B1 * 3/2004 Cole ..... 292/110

* cited by examiner

MOTORIZED OVEN LOCK FOR SEALING OVEN DOOR

CROSS REFERENCE

Cross reference is made to copending U.S. Patent application Ser. No. 10/730,475, entitled Motorized Oven Lock by Steve W. Smock, Harry I. Courter, Greg Wright and Tracy J. Talley, which is assigned to the same assignee as the present invention, and which is filed concurrently herewith, the disclosure of which is hereby totally incorporated by reference in its entirety.

BACKGROUND AND SUMMARY

This invention relates generally to door locks for self-cleaning ovens and more particularly to door locks wherein the act of closing the oven door positions a latch in a position to lock the door and a blocking device secures the latch in that position and pulls the door in snuggly against the frame of the oven when a self-cleaning cycle is initiated.

A conventional gas or electric oven is subject to collecting deposits from whatever is placed in the oven to be cooked. Modern ovens are designed to self-clean upon demand by reducing these deposits to dust with high heat. This cleaning method is commonly known as pyrolytic cleaning. The high temperature used for pyrolytic cleaning poses a hazard if the oven door is opened during the cleaning cycle. To prevent this, an oven door lock is employed.

Many types of oven door locks have been provided that lock the oven door for a period sufficient to complete a pyrolytic cleaning cycle once initiated. Many of these door locks use electrical motors, electromechanical machines or manual manipulation of mechanisms to move a latch to a position in which the latch prevents the oven door from being opened during a self-cleaning cycle. Examples of such locks are disclosed in Thuleen et al., U.S. Pat. No. 4,082,078; McWilliams, III, U.S. Pat. No. 5,493,099; Smith, U.S. Pat. No. 6,302,098; Swartzell, U.S. Pat. No. 6,315,336; and Malone et al., U.S. Pat. No. 5,220,153.

Barnett, U.S. Pat. No. 4,374,320 and Gilliom, U.S. Pat. No. 3,859,979 disclose oven door latches that are moved into a latched position and that are further moved by a motor to pull the door in closer to the frame or compress a seal between the door and the frame.

The disclosed oven lock mechanism uses the opening and closing of the oven door to position a latch member between a latched and an unlatched position and uses a relatively inexpensive motor to move a blocking member into a blocking position prohibiting the movement of the latch from the latched position to an unlatched position during a cleaning cycle. The rotation of the motor also induces additional movement of the latch from the latched position to a latched and pulled-in position.

According to one disclosed embodiment, an oven lock mechanism for use with an oven having a door and a frame configured so that the door is adjacent the frame when the door is closed includes a latch, an actuator pin, a motor and a cam. The latch is supported above and coupled to the frame to rotate about a pivot axis and is rotatable between an unlatched and latched position. The latch includes a follower surface offset from the pivot axis and a latching member extending beyond the frame for interacting with the door. The actuator pin is movably supported by the frame and includes an outer end extending beyond the frame for engaging the oven door upon closure and a cam end engaging the follower surface of the latch for rotating the latch into the latched position wherein the door is adapted to be captured by the latch. When actuated, the motor drives a shaft to which the cam is mounted for rotation thereabout. The cam is rotatable between a non-pulled-in position and a pulled-in position wherein the cam induces movement of the latch from the latched position to a latched and pulled-in position. The movement of the cam between the non-pulled-in position and the pulled-in position is accomplished by rotation of the cam by 60 degrees.

An oven lock mechanism for use with an oven having a door and a frame surrounding a cooking chamber having an opening selectively closed by engagement of the door with the frame includes a mounting plate, a latch, an actuator pin, a blocker and an electromechanical actuator. The mounting plate is mounted to the frame. The latch is mounted to the mounting plate for movement about a pivot axis and is rotatable about the pivot axis between an unlatched and latched position. The latch includes a follower surface offset from the pivot axis. The actuator pin is movably supported by the mounting plate and includes an outer end extending beyond the mounting plate for engaging the oven door upon closure and a cam end engaging the follower surface for rotating the latch into the latched position wherein the door is adapted to be captured by the latch. The electromechanical actuator is mounted to the base plate for driving a blocker selectably movable into a blocking position when the latch is in a latched position for interfering with the rotation of the latch such that the latch is locked into the latched position for locking the oven door in a closed position. Movement of the blocker into the blocking position induces additional movement of the latch to pull the oven door closer to the frame.

An oven lock mechanism for use with a self-cleaning oven having a door for selectively closing an opening of a cooking compartment surrounded by a frame and a compressible seal includes a mounting plate, a latch, a blockable member, an actuator pin, a blocker, and a motor. The mounting plate is coupled to the frame near the oven compartment opening. The latch is pivotably mounted to the mounting plate about a pivot axis and is rotatable between an unlatched and latched position. The latch includes a follower surface offset from the pivot axis. The blockable member is mounted for movement relative to the mounting plate. The blockable member is coupled to the latch so that when movement of the blockable member is blocked, movement of the latch from the latched to the unlatched position is inhibited. The actuator pin is movably supported by the mounting plate. The actuator pin includes an outer end extending beyond the mounting plate for engaging the oven door upon closure and a cam end engaging the follower surface for rotating the latch into the latched position wherein the door is adapted to be captured by the latch. The blocker is mounted for movement relative to the mounting plate to selectively block and unblock the blockable member. The motor is coupled to the mounting plate. When actuated the motor moves the blocker and induces additional movement of the latch from the latched position to a position wherein the oven door engages and compresses the seal.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

DETAILED DESCRIPTION OF THE DRAWINGS

Figure 1:
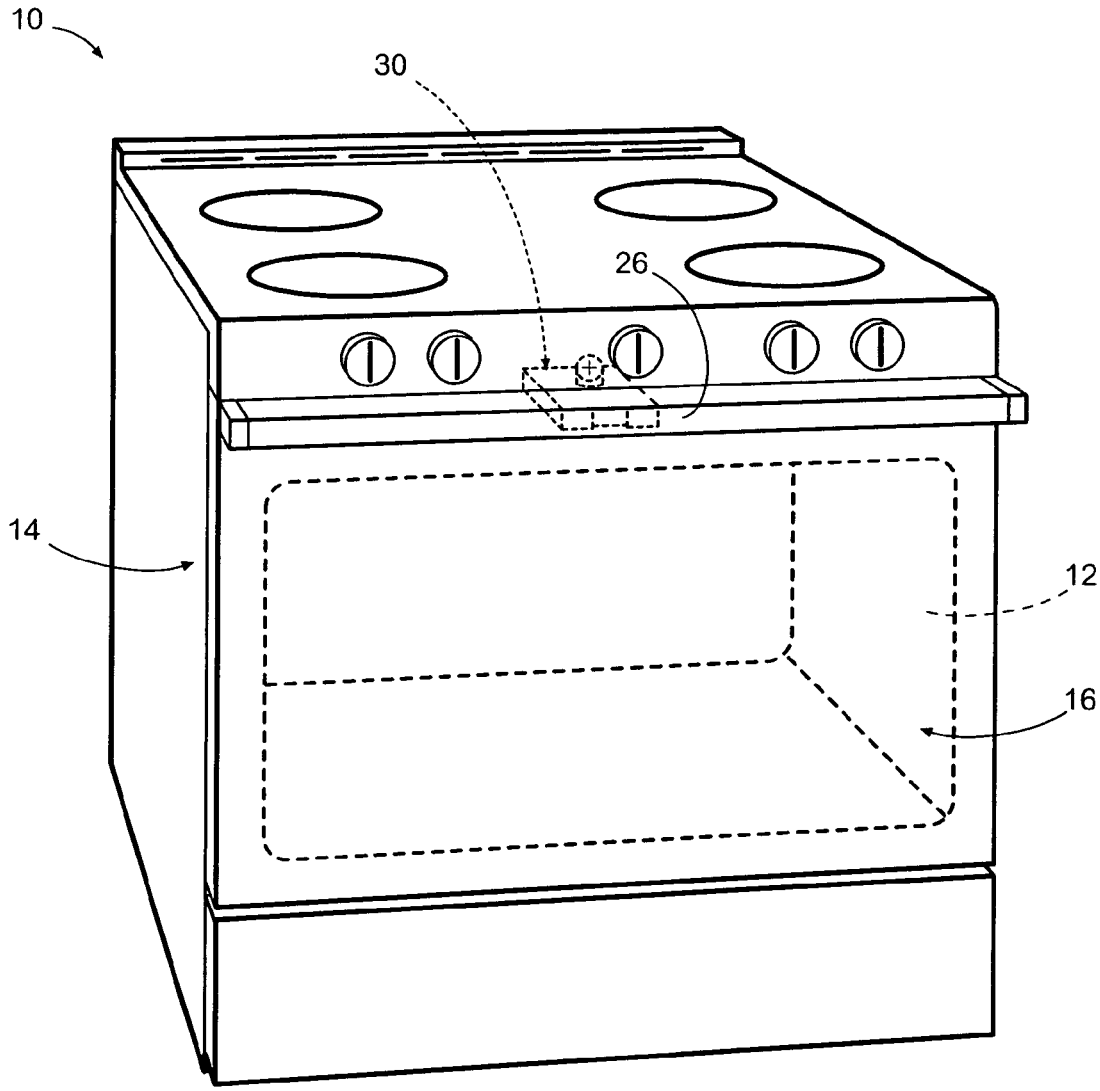
FIG. 1 is a perspective view of a self-cleaning oven with the oven door closed and a first embodiment of the oven lock mechanism shown in phantom lines mounted at the front of the oven fame above the cooking chamber and below the cook top.

The embodiments of the oven door lock mechanisms 30, 430 disclosed herein share the common feature of having the closure of the door 12 actuate movement of a latch 32, 432 into a position in which, if the latch 32, 432 did not move, the oven door 12 could not open. Such a position is referred to herein as a latched position. Both embodiments also share the common feature that unless the latch 32, 432 is blocked in the position that it assumes when the door 12 is closed, the process of opening the door 12 will result in movement of the latch 32, 432 to a position that will not inhibit door 12 from opening, i.e. an unlatched position. Both embodiments selectively block the latch 32, 432 in the latched position in response to an indication that a cleaning cycle is to begin. The blocking is accomplished by rotating a cam 46, 446 into engagement with the latch 32, 432 or into a position in which movement of the latch 32, 432 will induce engagement between the cam 46, 446 and the latch 32, 432. A motor and gear box 44 rotate the cam 46, 446 only sixty degrees for each change of state between the blocking and non-blocking position.

As shown, for example in FIG. 1, the first embodiment of a motorized oven lock 30 is configured for mounting in a self cleaning oven 10. The oven 10 includes a door 12 hinged at its bottom to a frame 14. The frame 14 of the oven 10 is disposed about an oven chamber 16. A cook top 18 is coupled to the frame and disposed above the oven chamber 16. The door 12 closes at an interface formed by an inner face 20 (FIG. 2) of the door 12 and an abutment surface 22 of the oven frame 14. As shown for example in FIGS. 2–4, inner face 20 of oven door 12 is provided with a seal 24 for engaging the abutment surface 32 of the frame 14 providing for a sealed oven chamber 16. Those skilled in the art will recognize that alternatively, the abutment surface 22 of the frame 14 may be provided with a seal for engaging the inner face 20 of the oven door 12. The first embodiment of the motorized oven door lock mechanism 30 is mounted at the top 26 of the frame 14 of the oven 10 just under the cook top 18 out of sight.

Figure 2:
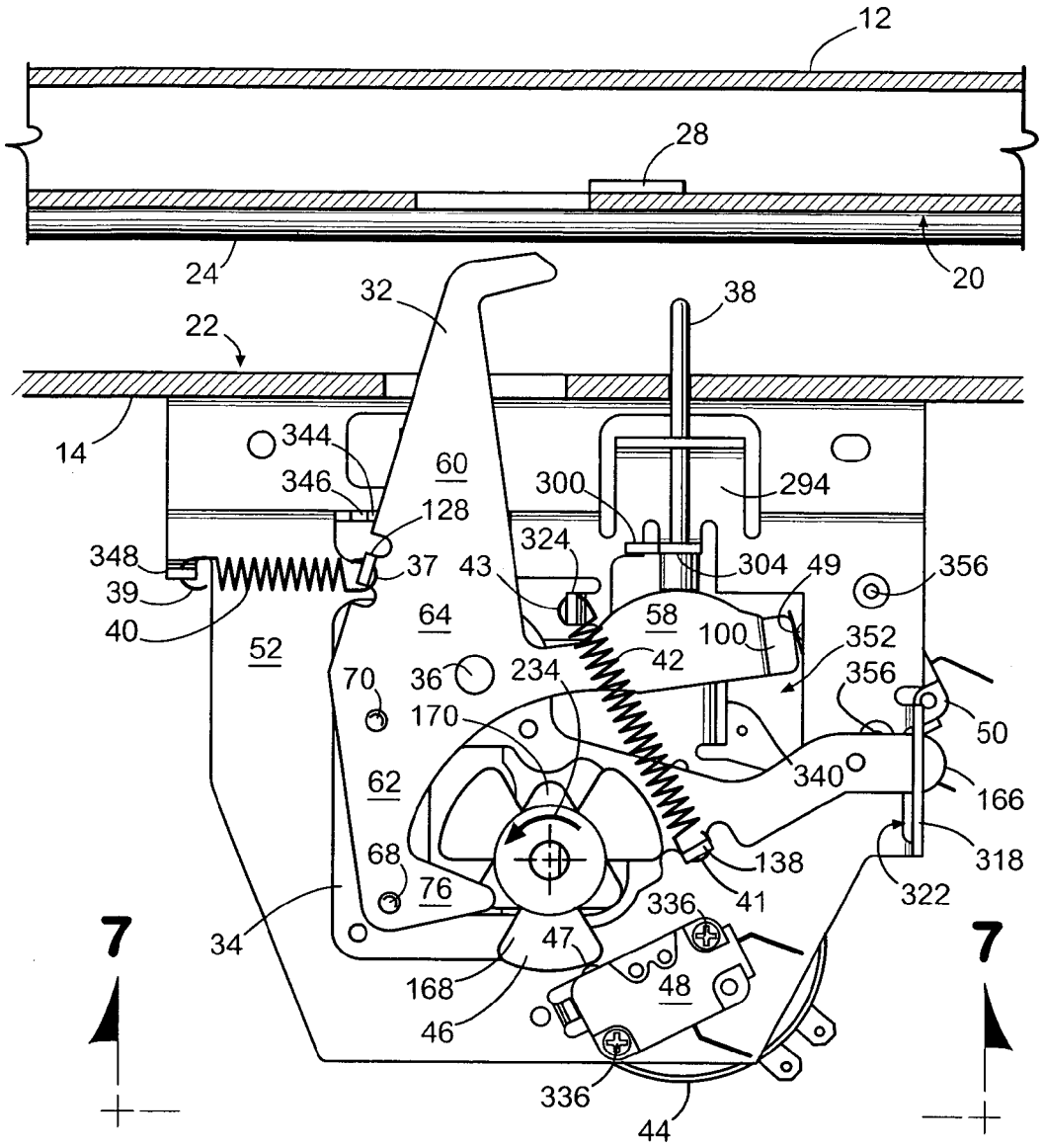
FIG. 2 is a bottom plan view with parts of the oven broken away of the oven lock mechanism and oven of FIG. 1 with the door of the oven open sufficiently to permit the latch of the oven lock mechanism to assume its normal unlocked position and showing a torque arm of the latch mechanism riding against a flat wall of a triangular cam in a forward position with a cantilevered arm of the torque arm engaging the front wall of a side channel.
Figure 7:
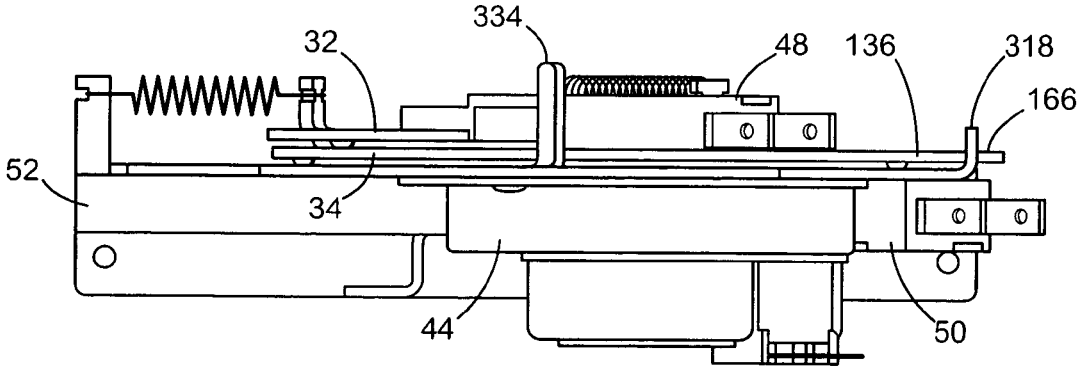
FIG. 7 is an elevation view taken along line 7—7 of FIG. 2 of the oven lock mechanism of FIG. 2.

As shown for example in FIG. 2, a first embodiment of a motorized oven lock mechanism 30 includes a latch 32, a torque arm 34, a slide shaft 36, an actuator pin 38, a latch bias spring 40, a torque arm bias spring 42, a motor and gear box 44, a dual cam 46, a cam-actuated switch 48, a latch-actuated switch 50 and a mounting plate 52.

The ends of the actuator pin 38 and latch 32 are exposed forward at the abutment surface 22 of the frame 14 that interfaces with the inside face 20 of the oven door 12. When the oven door 12 is closed, the inside face 20 of the door 12 engages and depresses the actuator pin 38. The actuator pin 38 depresses against the latch 32 and rotates the latch 32 to a position that traps the door 12. The switch 50 is activated by rotation of the latch 32 to the latched position. Activation of the switch 50 enables the self-cleaning function. If self-cleaning is selected, typically by user actuation of a switch on the oven control panel, a circuit is closed driving the motor and gear box 44 to rotate the dual cam 46. The cam 46 rotates to a position that traps the latch 32 in a blocked position. Rotation of the cam 46 induces a change of state of the cam-actuated switch 48. The cam-actuated switch 48 controls the proper position of the cam lobes. The cam-actuated switch 48 also signals to an electronic package a change in state. Such electronic packages for locking out motor movement during a self-cleaning cycle are well known. Examples of such electronics packages are disclosed in Gilliom, U.S. Pat. No. 3,859,979 and Barnett, U.S. Pat. No. 4,374,320, the disclosures of which are incorporated herein by this reference.

As shown, for example, in FIGS. 2–6, oven lock mechanism 30 includes an actuator pin 38 that is moved against a bias exerted by the latch bias spring 40 to a depressed position every time the oven door 12 is closed. In response to this action, the latch 32 is advanced into a latched position regardless of whether or not the oven 10 is to be placed in a self-cleaning mode of operation. When a user does place the oven 10 in the self-cleaning mode, an oven controller actuates the motor and gear box 44 to drive the dual cam 46 that acts as a block out member or blocker to a blocking position. When the cam 46 is placed in the blocking position, any attempt to open the oven door 12 will be unsuccessful since the block out member is positioned to prevent the latch 32 from pivoting back to its unlatched position. Once the self-cleaning cycle is completed, the oven controller actuates the motor and gear box 44 to drive the dual cam 46 back to a non-blocking position. When placed in such non-blocking position, an attempt to open the oven door 12 is successful since the cam 46 is positioned to allow the latch 32 to freely pivot back to its unlatched position.

More particularly, the mounting plate 52 of the oven lock mechanism 30 is mounted to the oven frame 14. The oven lock mechanism 30 is positioned relative to the frame 14 so that the latching arm 60 of the latch 32 and the rounded end 268 of the shaft 258 of the actuator pin 38 extend forwardly beyond the abutment surface 22 of the oven frame 14 when the oven door 12 is opened. This is to permit the oven door 12 to engage the rounded end 268 of the actuator pin 38 during closing to urge the pin 38 to reciprocate rearwardly to urge the latch 32 into a latching position.

As shown, for example, in FIGS. 2–10, the latch 32 is mounted to the torque arm 34 for pivotal movement about the pivot axis 216 (FIGS. 19–20) for movement between the latched position and an unlatched position. The torque arm 34 is mounted to the mounting plate 52 for reciprocal forward and rearward movement. As the torque arm 34 moves forwardly and rearwardly, the latch 32 pivotally mounted thereto also reciprocates forwardly and rearwardly between a non-cleaning latched position (FIG. 3) and a cleaning latched position (FIG. 6) or pulled-in position. The mounting plate 52 is rigidly mounted to the oven frame 14. The motor and gear box 44 are mounted to the mounting plate 52 so that its shaft 250 extends through the motor shaft-receiving hole 326 in the mounting plate 52. The dual cam 46 is mounted to the shaft 250 so that the triangular cam 170 is received in the cam-receiving aperture 150 defined in the main body 134 of the torque arm 34 and the three lobed cam shaft 168 is positioned to engage the blockable arm 62 of the latch 32 upon rotation of the motor and gear box 44.

Figure 3:
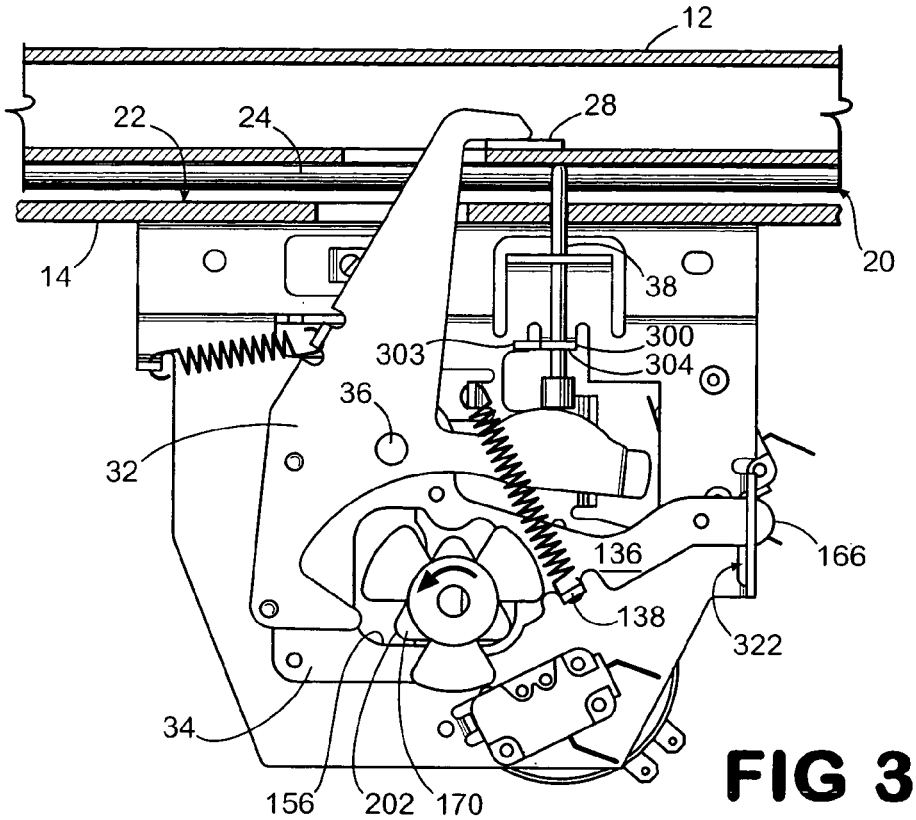
FIG. 3 is a plan view similar to FIG. 2 with the oven door closed resulting in the latch of the oven lock mechanism being urged into a latched position.
Figure 4:
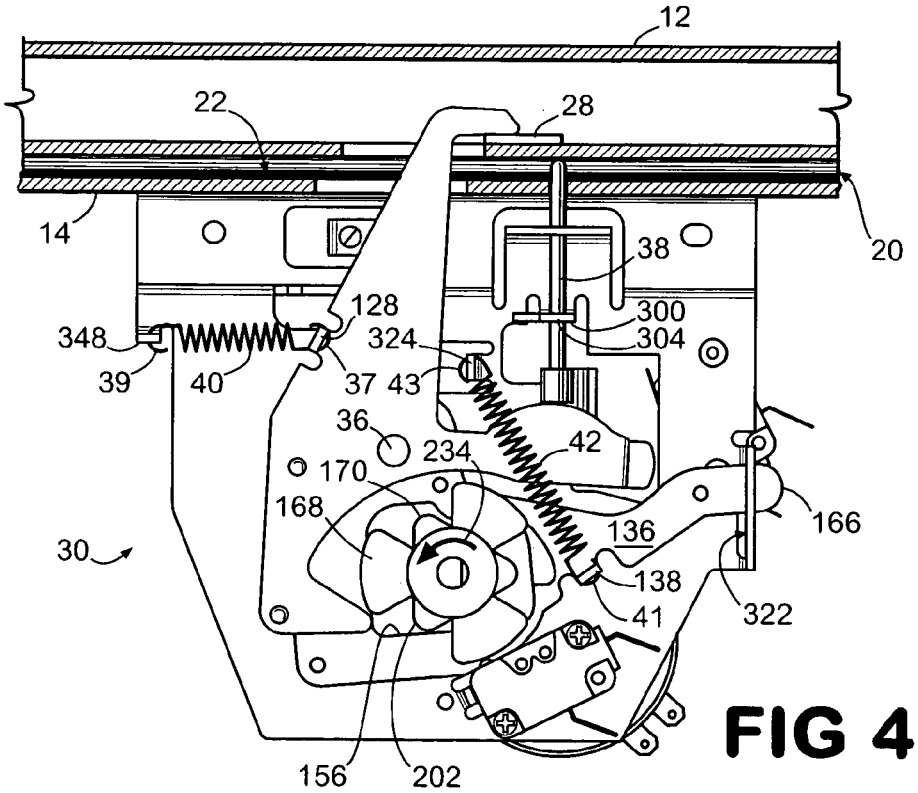
FIG. 4 is a plan view similar to FIG. 3 with the cam having rotated to pull the torque arm and latch rearwardly with a predetermined pull-in force with the cantilevered arm still engaging the front wall of the channel.
Figure 5:
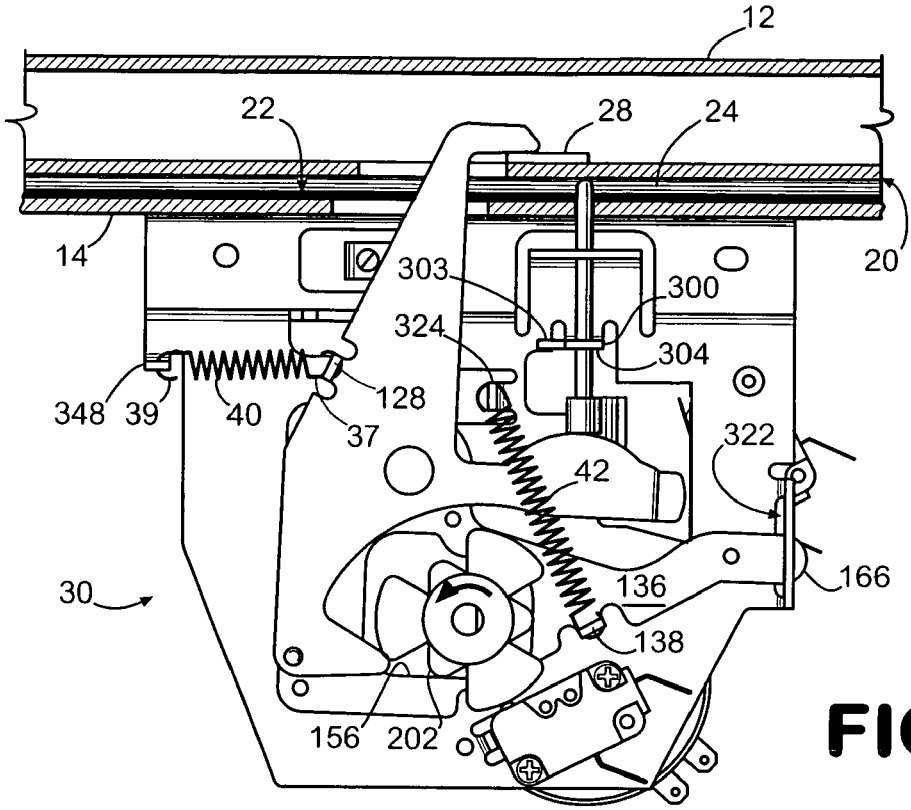
FIG. 5 is a plan view similar to FIG. 4 with the torque arm having rotated so that the cantilevered arm has slid rearwardly in the channel and the latch has slid slightly forward to relieve excess pull-in force.

When the oven door 12 is open, or when the door 12 is closed and a cleaning cycle has not been initiated, one side wall 200 of the triangular cam 170 is substantially parallel to the abutment surface 22 of the oven frame 14 as shown, for example, in FIGS. 2 and 3. This side wall 200 is in engagement with the flat rear follower wall 156 of the cam-receiving aperture 150 in the torque arm 34. The torque arm bias spring 42 urges the torque arm 34 and the latch 32 forward so that the flat follower surface 156 is biased against the side surface 200 of the triangular cam 170. Due to the arrangement of triangular cam 170 and three lobed cam 168, when the triangular cam 170 is so positioned, the three lobed cam 168 is positioned such that none of the lobes 178 interferes with rotational movement of the latch 32 and the blocked member 76 is free to pivot into and out of a void 194 between two of the cam lobes 178.

When the door 12 closes, the inner face 20 of the door 12 engages the rounded end 268 of the shaft 258 of the actuator pin 38 and urges the actuator pin 38 rearwardly. The cam surface 262 on the head 256 of the actuator pin 38 is pushed against the arcuate follower surface 98 of the follower arm 58 of the latch 32 inducing clockwise (as seen from the bottom, as shown, for example, in FIGS. 2–8) rotation of the latch 32 about the slide shaft 36 causing the latch bias spring 40 to be stretched to store a restorative force for returning the latch 32 to an unlatched position. Clockwise rotation of the latch 32 accomplishes at least three things, as shown, for example, in FIG. 3. First, the latching arm 60 is pivoted to within a slot in the door 12 of the oven 10 to a position in which the engaging wall 124 of the latching member 120 is adjacent to a striker plate 28 in the oven door 12. In this position, the latch 32 would prohibit outward movement of the door 12. Second, the blocked member 76 of the blockable arm 62 is pivoted out of one of the sixty degree voids 194 between lobes 178 of the three-lobed cam 168 of the dual cam 46. Third, the offset switch actuator arm 100 at the end of the follower arm 58 of the latch 32 is moved to a position in which it no longer engages the latch-actuated switch 50.

Latch-actuated switch 50 can also be referred to as the motor electrical actuator switch 50 because, when the contact button 49 is released by clockwise rotation of the actuator arm 100, switch 50 permits current flow to the motor and gear box 44. Thus, movement of the latch 32 into the latched position enables the motor and gear box 44 which may then move the cam 46 to a blocking position upon receipt of a signal initiating a cleaning cycle. When in the blocking position, the block out member, blocker or camming surface 188 of one of the three lobed-cams 178 of the dual cam 46 engages the follower surface 80 on the end of the blocked member 76 of the blockable arm 62 of the latch 32 preventing counter-clockwise rotation of the latch 32.

Not only does the disclosed oven lock mechanism 30 block the latch 32 from rotating from a latched position to an unlatched position after a cleaning cycle initiation signal has been received, but it also moves the latch 32 into a pulled-in position. In this pulled-in position the gasket or seal 24 disposed between the inner face 20 of the oven door 12 and the abutment surface 22 is compressed as the door 12 is pulled into a more snug engagement with the abutment surface 22. Counter-clockwise rotation of the dual cam 46 causes the three lobed cam 168 to place the camming surface 188 of one of its lobes 178 in engagement with the follower surface 80 of the blocked member 76 preventing rotation of the latching member 120.

Additionally, the triangular cam 170 as it turns sixty degrees brings a rounded corner 202 of the triangular cam 170 into engagement with the rear cam-follower wall 156 of the cam-receiving aperture 150 of the torque arm 34 forcing the torque arm 34, latch 32 and slide shaft 36 to move rearwardly with respect to the mounting plate 52. During this rearward movement, the slide shaft 36 slides rearwardly within the slot 306 in the mounting plate 52. Also, the engaging wall 124 of the latch 32 engages the striker plate or inner wall 28 of the oven door 12 and pulls the oven door 12 rearwardly causing the seal 24 to be compressed between the oven door 12 and the abutment surface 22 of the frame 14.

Figure 6:
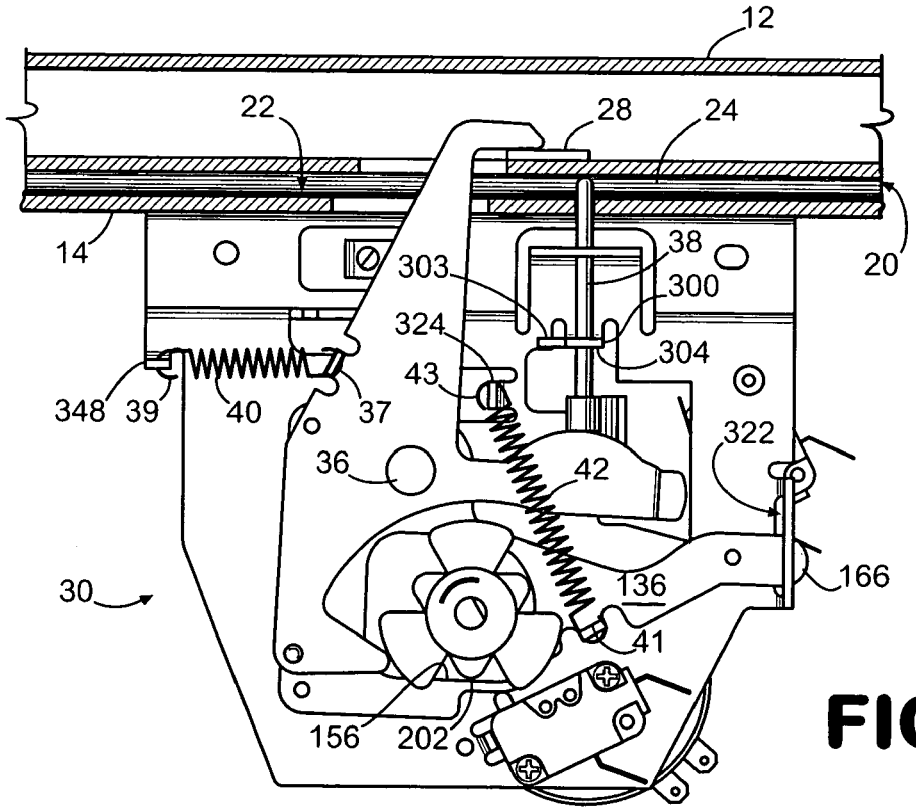
FIG. 6 is a plan view similar to FIG. 5 with the latch of the oven lock mechanism having been blocked in the latched position against returning to the unlatched position and the latch having been urged reward against the striker plate of the oven door to pull the oven door in toward the frame to compress the seal therebetween.
Figure 8:
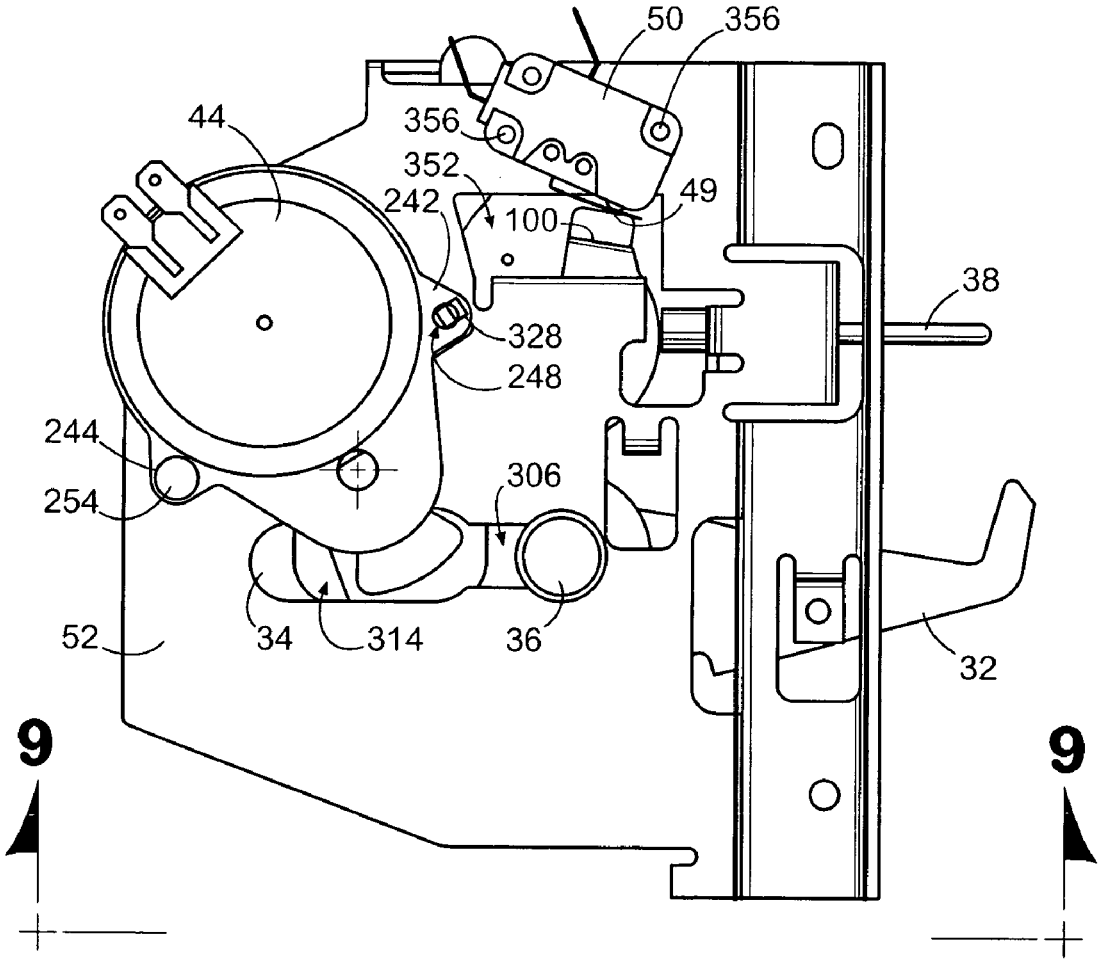
FIG. 8 is a top plan view of the oven lock mechanism of FIG. 2.
Figure 9:
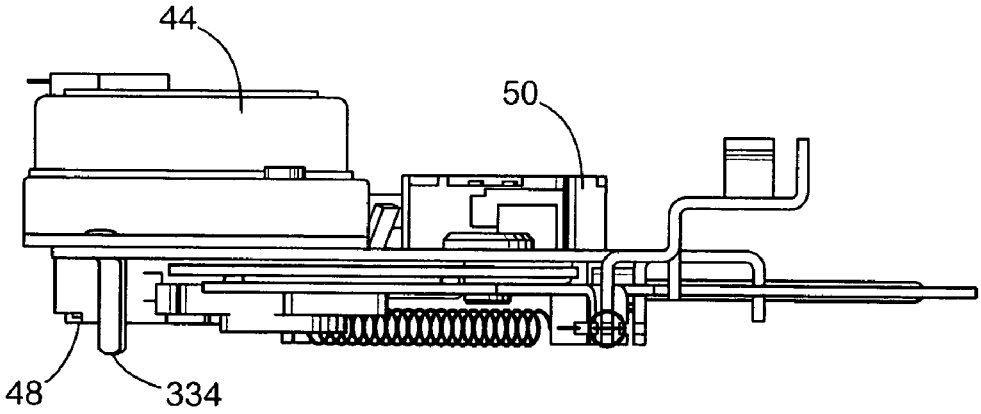
FIG. 9 is a side elevation view taken along line 9—9 of the oven lock mechanism of FIG. 8.
Figure 10:
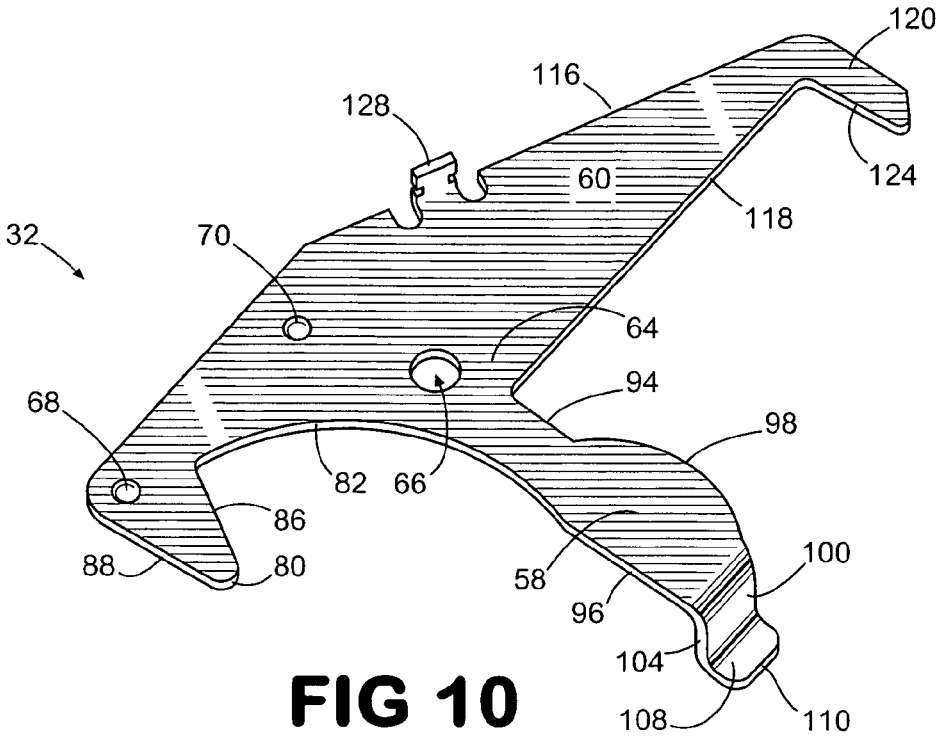
FIG. 10 is a perspective view of the latch of FIG. 2.
Figure 11:
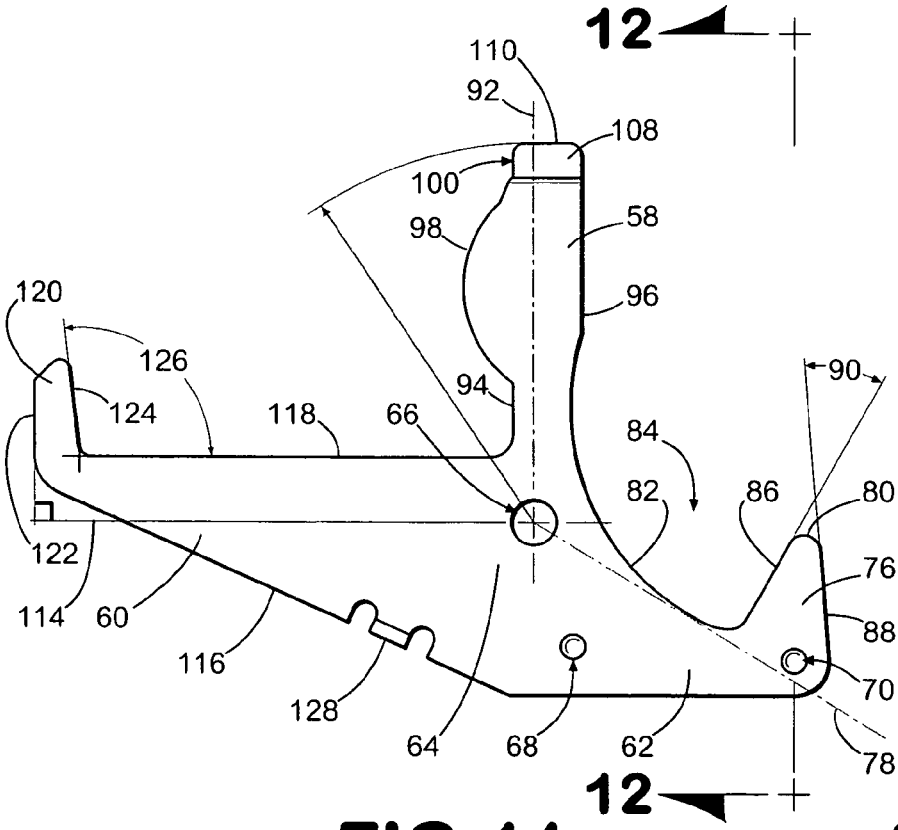
FIG. 11 is a plan view of the latch of FIG. 10.
Figure 12:
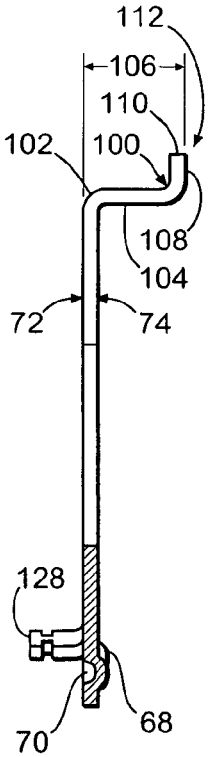
FIG. 12 is a side elevation view of the latch taken along line 12—12 of FIG. 11 with parts broken away.

As shown, for example, in FIG. 6, after the dual cam 46 rotates sixty degrees, the lobe 178 previously actuating the contact button 47 of the cam-actuated switch 48 rotates to a position in which the contact button 47 is released. Upon release of the contact button 47, a timer circuit (not shown) is initiated and further rotation of the motor and gear box 44 and the cam 46 attached thereto is locked out until the timer expires indicating the end of the cleaning cycle.

At the end of the cleaning cycle, the cam 46 again rotates sixty degrees permitting the torque arm 34 to be returned to its normally biased forward position. During movement of the torque arm 34 to its forward position, engaging wall 124 of latching arm 60 moves forward and out of engagement with the striker plate or inside surface 28 of the oven door 12. The three lobed cam 168 moves to a position in which the follower surface 80 of the blockable arm 62 of the latch 32 is no longer in engagement with the camming surface 188 of one of the lobes 178 of the three-lobed cam 168. The blocked member 76 is no longer blocked from moving counter-clockwise into a sixty degree void 194 between lobes 178, however, the actuator pin 38 continues to engage the follower surface 98 of the follower arm 58 of the latch 32 overcoming the attempts of the bias spring 40 to return the latch 32 to the unlatched position. Only when the door 12 is pulled open and the door springs (not shown) are no longer forcing the oven door 12 against the actuator pin 38 does the latch bias spring 40 induce counter-clockwise rotation of the latch 32 causing the latch 32 to return to the unlatched position.

The manner of operation of the oven lock mechanism 30 can be better understood by understanding the configuration and interaction of the various components of the oven lock mechanism 30. These components are designed and configured to facilitate the above described manner of operation of the oven lock mechanism 30. Understanding of the oven lock mechanism 30 is facilitated by recognizing that the mechanism 30 is mounted to the frame 14 of the oven 10 so that the motor and gear box 44 extend upwardly from the mounting plate 52. Thus, FIGS. 2–8 depict the oven lock mechanism 30 as viewed from the bottom looking up. As previously mentioned, the oven lock mechanism 30 includes a latch 32, a torque arm 34, a slide shaft 36, an actuator pin 38, a latch bias spring 40, a torque arm bias spring 42, a motor and gear box 44, a dual cam 46, a cam-actuated switch 48, a latch-actuated switch 50 and a mounting plate 52.

The latch 32 is configured to facilitate being rotated into a latched position by closure of the oven door 12 and being blocked in that position. As shown, for example, generally in FIGS. 2–11, and more particularly in FIGS. 10–14, latch 32 includes a follower arm 58, a latching arm 60 and a blockable arm 62 all extending generally radially from a central body 64 formed to include a pivot pin-mounting hole 66. Pivot pin-mounting hole 66 is sized to receive the pivot pin cylindrical shaft 214 of the slide shaft 36 therein. The latch 32, except for an offset switch actuator arm 100 at the distal end 102 of the follower arm 58, dimples 68, 70 and a spring anchor finger 128, is substantially planar having a bottom surface 72 and a top surface 74 Latch 32 is configured to pivot about a pivot axis 216 extending through the slide shaft 36. The latch 32 is mounted for pivotal movement relative to the torque arm 54 and the mounting plate 52. Since, as explained further hereafter, slide shaft 36 moves in a reciprocal fashion forwardly and rearwardly with respect to the mounting plate 52, the latch 32 moves forwardly and rearwardly with respect to the mounting plate 52. Since the latch 32 and the torque arm 34 are both mounted to the slide shaft 36, latch 32 rotates about a fixed pivot axis 216 with respect to the torque arm 34. Such pivot axis 216 is not however, fixed with respect to the mounting plate 52.

Generally, the main body 64 and the blockable arm 62 of the latch 32 are mounted so that they are positioned below portions of the torque arm 34. During formation of the latch 32, dimples 68, 70 are stamped or otherwise formed in the blockable arm 62 and the main body 64, respectively, of the latch 32. As shown, for example, with respect to the dimple 68 in FIG. 12, each dimple 68, 70 forms a pit extending into the bottom surface 72 of the latch 32 and forms a boss extending outwardly from the top surface 74 of the latch 32. The bosses of dimples 68, 70 ride on the lower surface 130 of the torque arm 34 during rotation of the latch 32 with respect to the torque arm 34 to aid in reducing friction between the two. Bosses of dimples 68, 70 also tend to aid in maintaining the substantially parallel relationship between the top surface 74 of the latch 32 and the lower surface 130 of the torque arm 34. Additionally, the bosses of the dimples 68, 70 help to maintain a horizontal separation between the latch 32 and the torque arm 34 so that the latch 32 engages only the lower three lobed cam 168 and the torque arm 34 engages only the upper triangular cam 170 of the dual cam 46.

The blockable arm 62 is formed to include a blocked member 76 extending laterally with respect to an axis 78 extending through the blockable arm 62 and the mounting hole 66. The blocked member 76 includes a rounded follower surface 80 at its lateral extreme surface. Blocked member 76 extends generally laterally outwardly from a concave arcuate clearance surface 82 formed in portions of the blockable arm 62 and portions of the rear surfaces of the main body 64 and follower arm 58. The clearance surface 82 is provided to permit a lobe 178 of the three lobed cam 168 of the dual cam 46 to extend into the void 84 between the blocked member 76 and the follower arm 58 as shown, for example, in FIG. 2.

Figure 13:
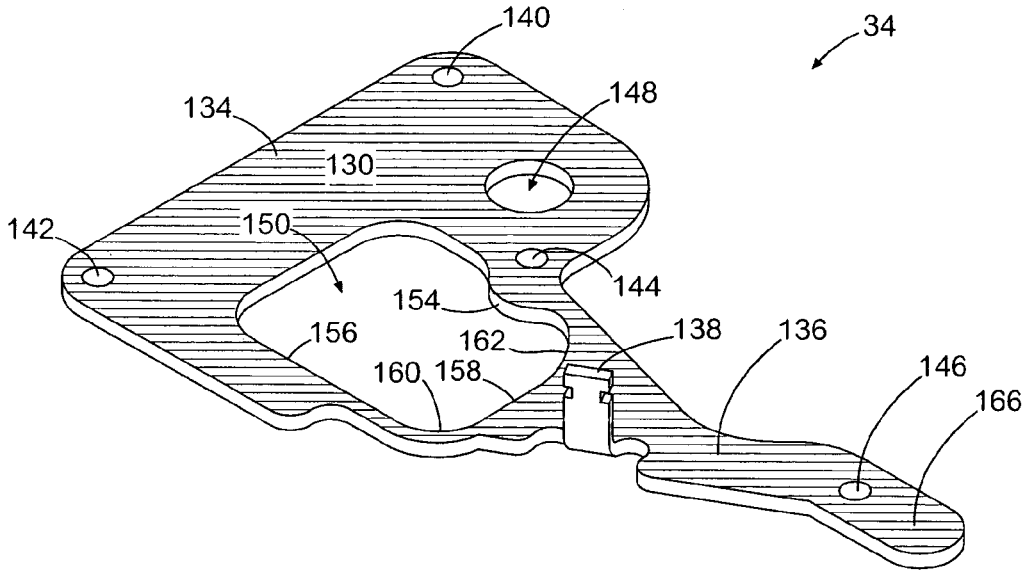
FIG. 13 is a perspective view of the torque arm of FIG. 2.

Blocked member 76 includes front wall 86 and rear wall 88 extending laterally inwardly from axis 78 and meeting at the rounded follower surface 80 to form an angle 90 therebetween, as shown, for example, in FIG. 13. In the illustrated embodiment, the angle 90 between the front wall 86 and the rear wall 88 of the blocked member 76 is approximately thirty-five degrees. The shape of the blocked member 76 permits the blocked member 76 to extend into a void 194 between each two lobes 178 of the three lobed cam 168 of the dual cam 46 when the latch 32 is in an unlatched position, as shown, for example, in FIG. 2.

The follower arm 58 of the latch 32 includes an axis 92, a front surface 94, a rear surface 96, an arcuate follower surface 98 and an offset switch actuator arm 100. The axis 92 of the follower arm 58 extends radially outwardly from the pivot pin-mounting hole 66. The front surface 94 and the rear surface 96 of the follower arm 58 are generally parallel, except in the region of the arcuate follower surface 98 and arcuate clearance surface 82, to the axis 92. Convex arcuate follower surface 98 extends forwardly from front surface 94 of the follower arm 58. In the illustrated embodiment, follower surface 94 has a radius of curvature centered on the rear surface 96 of the follower arm 58. Arcuate follower surface 98 provides a surface for cam surface 262 of the actuator pin 38 to bear against. Thus, inward rectilinear movement of the actuator pin 38 induces the follower arm 58 to be urged to rotate clockwise about pivot axis 216.

The offset switch actuator arm 100 is an L-shaped arm extending upwardly and outwardly from the distal end 102 of the follower arm 58. The upwardly-extending leg 104 has a length 106 sufficient to permit L-shaped arm to extend through an aperture 352 in the mounting plate 52. The outwardly-extending arm 108 extends outwardly from the top of upwardly-extending arm 104. A switch actuator surface 110 on the outer end 112 of the outwardly-extending arm 108 is curved with a radius of curvature centered at the focus of the pivot pin-mounting hole 66. Thus, so long as the switch actuator surface 110 remains in contact with the contact button 49 of the latch-actuated switch 50 during rotation of the latch 32, the switch actuator surface 110 applies a constant force to the contact button 49. When the oven door 12 is closed, as shown, for example, in FIG. 3, the follower arm 58 is rotated sufficiently so that switch actuator surface 110 does not engage the contact button 49.

The latching arm 60 of the latch 32 includes an axis 114, an outside wall 116, an inside wall 118, and a latching member 120. The axis 114 of latching arm 60 extends radially from the pivot pin-mounting hole 66. In the illustrated embodiment, the axis 114 of the latching arm 60 is perpendicular to the axis 92 of the follower arm 58. As shown, for example, in FIG. 11, the inside wall 118 is parallel to the axis 114 of the latching arm 60. The latching arm 60 tapers as it extends forward resulting in the outside wall 116 forming an angle with the axis 114. The latching member 120 includes an end wall 122 and an engaging wall 124. The engaging wall 124 extends inwardly and slightly forwardly from inside wall 118 at an angle 126. In the illustrated embodiment, angle 126 is ninety-seven degrees. The angle 126 between the inside wall 118 and the engaging wall 124 is formed to cause the engaging wall 124 to be substantially parallel with the striker plate 28 in the oven door 12 when the latch 32 is in its latched position.

Near the junction of the latching arm 60 and the main body 64 of the latch 32, a latch bias spring anchor finger 128 extends downwardly from the bottom surface 72 of the latch 32. Spring anchor finger 128 is formed to include notches therein for receipt of the latch end 37 of the latch bias spring 40. Latch bias spring 40 biases the latch 32 toward the unlatched position.

Figure 14:
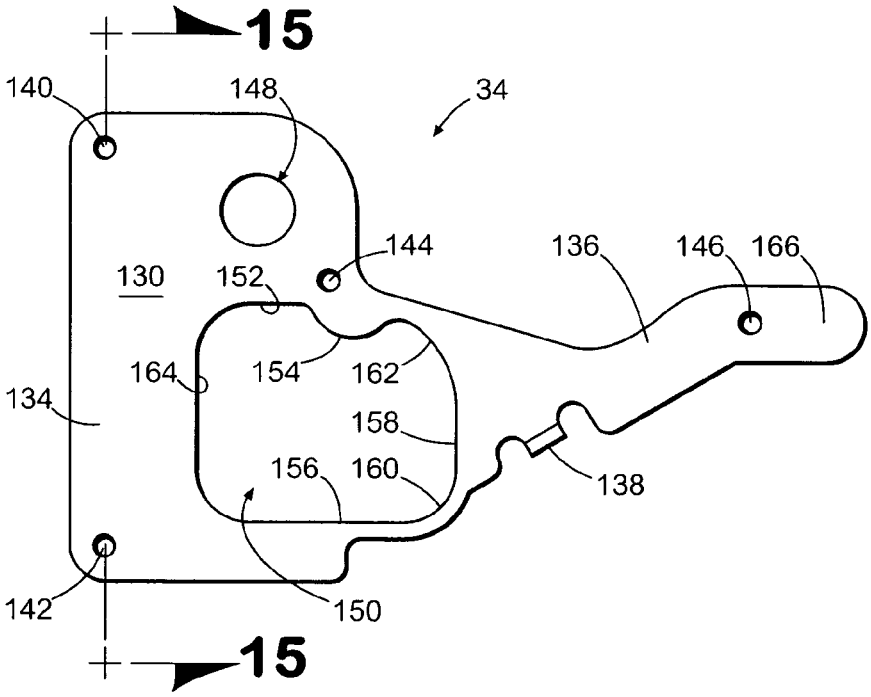
FIG. 14 is a plan view of the torque arm of FIG. 13.
Figure 15:
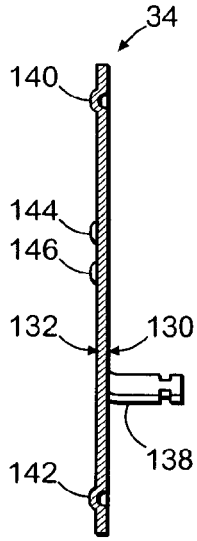
FIG. 15 is a sectional view of the torque arm taken along line 15—15 of FIG. 14.

As shown, for example, in FIGS. 13–15, the torque arm 34 includes a lower surface 130, an upper surface 132, a main body 134 and a cantilevered arm 136. In the illustrated embodiment, except for the downwardly extending spring anchor finger 138 and the plurality of dimples 140, 142, 144, 146, the lower surface 130 and the upper surface 132 of the torque arm 34 are substantially planar and parallel to each other.

During formation of the torque arm 34, dimples 140, 142, 144, 146 are stamped or otherwise formed in the main body 134 and the cantilevered arm 136 of the torque arm 34. As shown, for example, with respect to dimples 140 and 142 in FIG. 15, each dimple 140, 142, 144, 146 forms a pit extending into the lower surface 130 of the torque arm 34 and forms a boss extending outwardly from the upper surface 132 of the torque arm 34. The bosses of dimples 140, 142, 144, 146 ride on the bottom surface 270 of the mounting plate 52 during reciprocal movement of the torque arm 34 with respect to the mounting plate 52 to aid in reducing friction between the two. Bosses of dimples 140, 142, 144, 146 also tend to aid in maintaining the substantially parallel relationship between upper surface 132 of the torque arm 34 and the bottom surface 270 of the mounting plate 52. Additionally, the bosses of the dimples 140, 142, 144, 146 help to maintain a horizontal separation between the torque arm 34 and the mounting plate 52 so that upper triangular cam 170 of the dual cam 46 engages only the torque arm 34.

The main body 134 is formed to include a slide shaft-mounting hole 148 and a triangular cam-receiving aperture 150 to facilitate reciprocal forward and rearward movement of the torque plate 34 with respect to the mounting plate 52. The slide shaft-mounting hole 148 is sized to receive the slot riding cylindrical shaft 212 of the slide shaft 36 therein to mount the torque arm 34 for rectilinear movement with respect to the mounting plate 52 as guided by the slide shaft 36 sliding within slot 306. The triangular cam-receiving aperture 150 is formed to engage surfaces of the triangular cam 170 of the dual cam 46 so that rotation of the dual cam 46, as well as the restorative force stored in the torque arm bias spring 42, induce reciprocal movement of the torque arm 34 forwardly and rearwardly with respect to the mounting plate 52.

The triangular cam-receiving aperture 150 includes a front wall 152 formed to include an arcuate cam follower surface 154, a substantially flat rear cam follower wall 156, a substantially flat cam follower side wall 158, a curved region 160 joining the flat rear wall 156 to the flat side wall 158, a curved region 162 joining the flat side wall 158 to the front wall 152 and an opposite side wall 164. The triangular cam 170 never engages the opposite side wall 164. Because the bias spring 42 is urging the torque arm 34 into its forward non-blocked position, the triangular cam 170 constantly engages the flat back wall 156 of the cam-receiving aperture 150. When the triangular cam 170 is in the non-blocked position, a flat side 200 of the triangular cam 170 contiguously engages and abuts the flat rear cam follower wall 156.

As the dual cam 46 rotates to the blocked and pulled-in position, a first rounded corner 202 of the triangular cam 170 urges the torque arm 34 rearwardly. During rearward movement of the torque arm 34, a second rounded corner 202 of the triangular cam 170, i.e. the rounded corner 202 rotating ahead of the first rounded corner 202, follows the curved region 160 and flat side wall 158 to inhibit lateral movement of the torque arm 34. As the torque arm 34 moves rearwardly, the slide shaft 36 received in the slide shaft-mounting hole 148 moves rearwardly in the slot 306 causing the latch 32 mounted on the slide shaft 36 to move rearwardly. During this rearward movement, the torque arm bias spring 42 is stretched to store a restorative force for urging torque arm 34 forwardly when the dual cam 46 rotates at the end of a self cleaning cycle.

When the cleaning cycle is complete and the dual cam 46 again begins to rotate, the second point 202 of the triangular cam 170 will follow the flat side wall 158 and the curved region 162 continuing to inhibit lateral movement of the torque arm 34. Typically, the second point 202 of the triangular cam 170 will not engage the arcuate cam follower surface 154 on the front wall 150 during normal mechanical movement. During normal operation, as the dual cam 46 rotates, the torque arm bias spring 42 urges the torque arm 34 forward to position the latch 32 in an unblocked, non-pulled-in, latched position.

The second point 202 of the triangular cam 170 may engage the arcuate cam follower surface 154 on the front wall 150 under certain failure conditions. For example, should the torque arm 34 become stuck when in the pulled-in state so that it does not freely move relative to the mounting plate 52, the second point 202 of the triangular cam 170 will contact and push against the arcuate cam follower surface 154 on the front wall 150 to aid the bias spring 42 in initiating forward movement of the torque arm 34 as the dual cam 46 is rotating to the non-pulled-in, non-blocked position.

The second point 202 of the triangular cam 170 also engages the arcuate follower surface 154 if the torque arm bias spring 42 breaks, becomes uncoupled from either the torque arm 34 or the mounting plate 52 or for some other reason fails to supply a restorative force to urge the torque arm 34 forward. Under those circumstances, the second point 202 of the triangular cam 170 will engage and push against the arcuate cam follower surface 154 on the front wall 150 to initiate forward movement of torque arm 34 as the dual cam 46 is rotating to the non-pulled-in, non-blocked position to position the latch 32 to allow the oven door 12 to be opened.

The cantilevered arm 136 extends from the main body 134 of the torque arm 34 a sufficient distance so that the distal end 166 of the cantilevered arm 136 is received in the channel 322 formed along the side 320 of the mounting plate 52. When the oven latch mechanism 30 is in the unlatched position, as shown for example in FIG. 2, and in the latched but not blocked or pulled-in position, as shown for example, in FIG. 3, the torque arm bias spring urges the front wall of the cantilevered arm 136 near the distal end 166 into engagement with the front wall of the channel 322 During reciprocal movement of the torque arm 34, the distal end 166 of the torque arm 34 initially remains in contact with the front wall of the channel 322 and acts as a fuilcrum of a lever with the force being exerted by the first rounded corner 202 of the triangular cam 170 on the rear follower wall 156 of the triangular cam-receiving opening 150 and a force being exerted by the spring 42 on the spring finger 138 of the cantilevered arm 136. As the triangular cam 170 rotates, the torque arm 34 moves rearwardly guided by the slide shaft 36 and the walls of the slot 306 formed in mounting plate 52. Torque arm 34 also pivots slightly about slide shaft 36 (as shown, for example, in FIG. 4 by the fact that back wall 156 of cam-receiving cavity being rotated to no longer be parallel with frame 14.) As shown, in FIG. 4, rearward movement of torque arm 34 induces rearward movement of latch 32. As latch 32 moves rearwardly, engaging wall 124 of latching member 120 pulls against striker plate 28 to pull the oven door 12 toward the frame 14 compressing seal 24 between inner face 20 of oven door 12 and abutment surface 24 of frame 14.

Distal end 166 of cantilevered arm 136 of torque arm 34 may move reciprocally forwardly and rearwardly within the channel 322 as needed to compensate for variation in range assemblies regarding the door 12 meeting the front frame 14. Those skilled in the art will recognize that the seal 24 surrounding the oven compartment 16 need only be compressed by a small amount to seal the oven compartment 16 during self-cleaning cycles. However, due to manufacturing tolerances among components, the amount which the seal 24 can be compressed by the door 12 being pulled-in by latch 32 varies from oven to oven. Nevertheless, the amount of seal compression required remains substantially constant between ovens. As the seal 24 is compressed, the forward force exerted by the seal 24 on the oven door 12 increases thereby increasing the force exerted by the rear wall 156 of the cam-following opening 150 on the triangular cam 170. If the force exerted by the rear wall 156 of the cam-following opening 150 on the cam 170 were to become too great, the torque exerted on the motor and gear box 44 could result in motor stall. To avoid this, cantilevered arm 166 of torque arm 34 is permitted to slide rearwardly within channel 322 when the force exerted by the latch 32 on the door 12 (or conversely by the compressed seal 24 on the door 12) exceeds a predetermined force.

Those skilled in the art will recognize that the predetermined force at which the cantilevered arm 166 will move rearwardly within the channel 322 is dependent upon several variables including, but not limited to, the spring constant of the torque arm bias spring 42, the mounting locations 138, 324, 303 of the ends 41, 43 of the torque arm bias spring 42 on the torque arm 34 and on the mounting plate 52, respectively, the relationship between the moment arms created between the pivot pin-receiving aperture 148 and the contact point 202 of the triangular cam 170 on the cam-follower surface 150 and the mounting location 138 of the spring 42, and the frictional forces present between the torque arm 34 and the mounting plate 52. Those skilled in the art will recognize that the illustrated embodiment of the mounting plate 52 is formed with an alternative torque arm bias spring mounting location 303 on the top end of the actuator pin mounting bracket 300. Thus, mounting plate end 43 of torque arm bias spring 42 can be mounted to either the finger 324 or the alternative mounting location 303 on the top end of the actuator pin mounting bracket 300 to adjust the force at which the cantilevered arm 166 will move rearwardly within the channel 322 to relieve excess torque on the motor and gear box 44.

In the illustrated embodiment, a plurality of torque arm bias springs 42 of different unstretched lengths and different spring constants were coupled between the mounting finger 138 on torque arm 34 and either the mounting finger 324 or the alternative mounting location 303 on the top end of the actuator pin mounting bracket 300 and the force required to induce rearward movement of the cantilevered arm 166 within the channel 322 was tested. After sufficient iterations, an appropriate spring 42 and mounting location 324 was selected for obtaining the desired compression force on the seal 24. In the illustrated embodiment, the preselected force of six pounds is obtained by mounting a bias spring 42 having a spring constant of three pounds between mounting finger 138 on torque arm 34 and mounting finger 324 on mounting plate 52. Those skilled in the art will recognize that the force can be adjusted by altering the one or more of the mounting locations, the spring constant or the unstretched spring length to obtain the desired compression of the seal 24.

Thus, as shown, for example, in FIGS. 2–3, initially cantilevered arm 166 engages the front wall of channel 322 which acts as a fulcrum about which torque arm 34 pivots in response to rotation of cam 46. As cam 46 rotates, torque arm 34 moves rearwardly pulling latch 32 rearwardly into engagement with the oven door 12. Door 12 is pulled-in against seal 24 which exerts an outward force on door 12. When this outward force exceeds a predetermined amount, torque arm bias spring 42 can no longer maintain distal end 166 of cantilevered arm 136 in contact with the front wall of the channel 322. Torque arm bias spring 42 stretches a cantilevered arm 136 moves rearwardly in the channel 322, cam follower rear wall 150 slides along rounded corner 202 of triangular cam 170 to bring the back wall 150 closer to parallel with the frame 14 allowing the slide shaft 36, and the latch 32 coupled thereto, to slide slightly forward in the slot 306. This forward movement of latch 32 relieves some of the force exerted by the compressed seal 24 on the inner face 20 of the door 12 and the torque exerted by the cam follower wall 150 on the triangular cam 170. Thus, cam 170 does not stall and can continue to rotate until the rounded corner 202 of triangular cam 170 is pointed rearwardly as shown, for example, in FIG. 6. When the cam 46 has reached the position shown in FIG. 6, i.e. rotated sixty degrees from the position shown in FIG. 2, motor and gearbox 44 stop until the end of the self-cleaning cycle.

As shown for example, in FIGS. 2–6, the dual cam 46 rotates in the direction of the arrow 234 which, from the bottom of the oven 10, is counterclockwise. Therefore in describing components of the dual cam 46, the terms "leading" and "trailing" will be used to describe various components with the understanding that "leading" refers to a component that is counterclockwise with respect to the "trailing" component.

Figure 16:
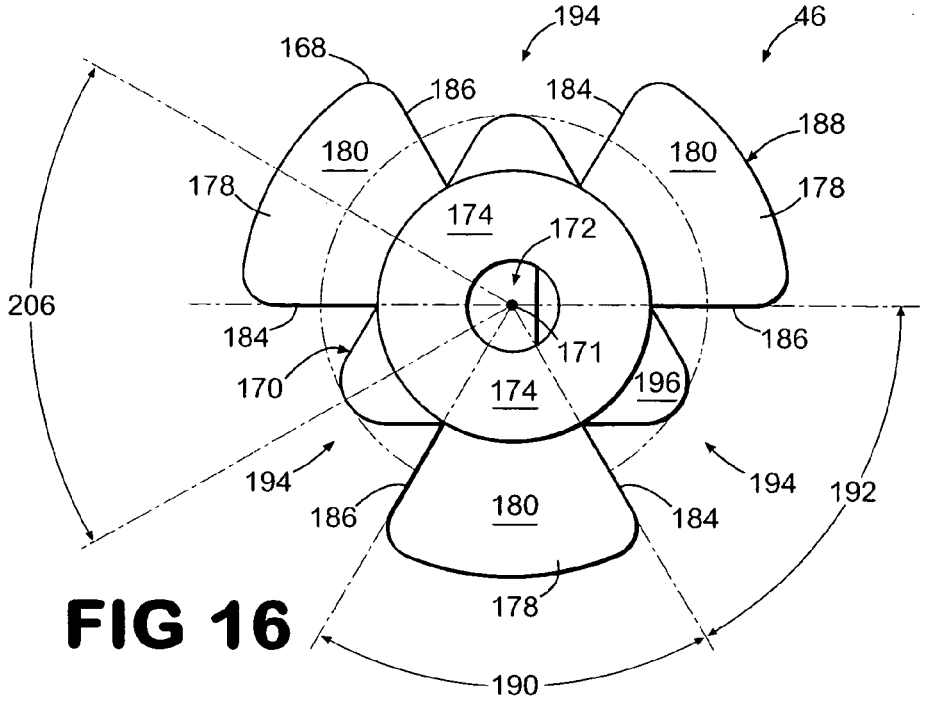
FIG. 16 is a bottom plan view of the dual cam of FIG. 2.
Figure 17:
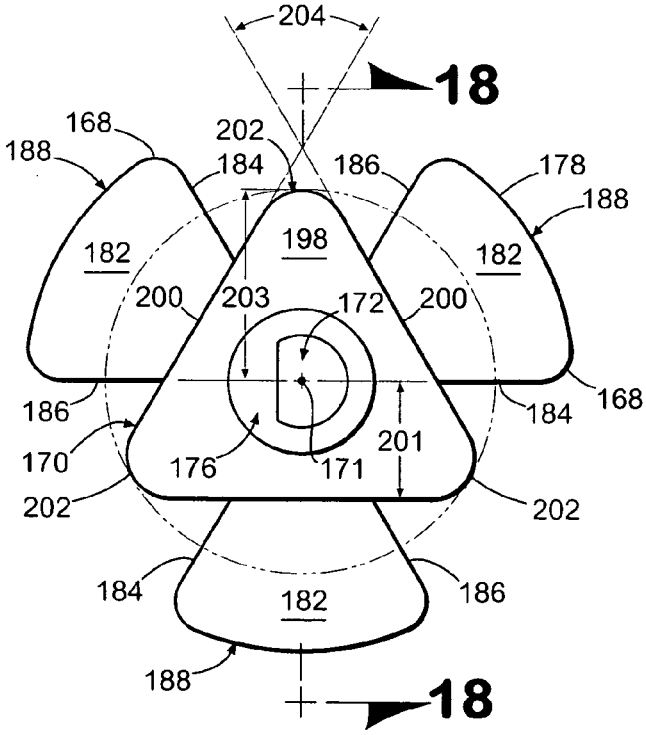
FIG. 17 is a top plan view of the dual cam of FIG. 16.
Figure 18:
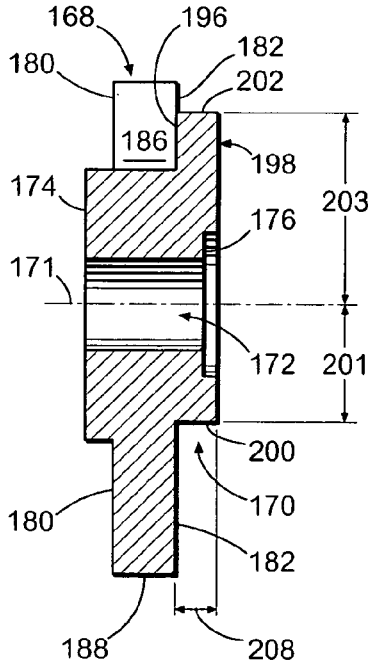
FIG. 18 is a sectional view of the dual cam taken along line 18—18 of FIG. 17.

As shown, for example, in FIGS. 16–18, dual cam 46 includes a three lobed cam 168 and a triangular cam 170 formed symmetrically around an axis 171 extending through the D-shaped shaft-mounting bore 172 extending through an otherwise generally cylindrical body 174. The D-shaped motor driven shaft 250 is received in D-shaped mounting bore 172 to couple the dual cam 46 to the shaft 250. As shown, for example, in FIG. 18, a counterbore 176 is formed on the topside of the dual cam 46 to accommodate the shaft bearing 252 of the motor and gear box 44. While disclosed as a dual cam 46, separate triangular and three lobed cams fastly joined to the motor driven shaft 250 are within the scope of the disclosure.

As shown, for example, in FIG. 17, the three lobed cam 168 includes three indistinguishable lobes 178 extending radially from the axis 171 of the generally cylindrical body 174 of the dual cam 46. Each lobe 178 includes a bottom surface 180, a top surface 182, a leading side wall 184, a trailing side wall 186 and a camming surface 188. Camming surface 188 extends between the leading and the trailing side walls 184, 186. The leading side walls 184 and the trailing side walls 186 extend radially from the generally cylindrical body 174. The leading side wall 184 and trailing side wall 186 of each lobe 178 form an angle 190 of sixty degrees with respect to each other.

Additionally, the trailing side wall 186 of each lobe 178 forms an angle 192 of sixty degrees with the leading side wall 184 of its trailing lobe 178, as shown, for example, in 5 FIG. 16. Thus, the trailing side wall 186 of each lobe 178 and the leading side wall 184 of its trailing lobe 178 define a sixty degree void 194. Also the leading side wall 184 of a cam 178 and the trailing side wall 186 of its trailing cam 178 are diametrically opposed.

The camming surface 188 of each lobe 178 is generally arcuate shaped having a radius of curvature centered at the axis 171 of the mounting bore 172. However, 10 at the junctures of the camming surface 188 with the leading side wall 184 and the trailing side wall 186, the camming surface 188 and the side walls 184, 186 are radiused.

The radiused junctures of the camming surface 188 and the side walls 184, 186 facilitate smooth engagement and disengagement of the camming surface 188 with the follower surface 80 of the blocked member 76 of the latch 32 during rotation of the dual cam 46.

As shown for example, in FIGS. 17 and 18, triangular cam 170 includes a bottom surface 196, a top surface 198, three side walls 200 and three rounded corners 202. Triangular cam 170 is generally, except for the rounding of corners 202, in the shape of an equilateral triangle centered on the axis 171 of the shaft-mounting bore 172.

Thus each side wall 200 forms an angle 204 of sixty degrees with its trailing side wall 20 200. As shown, for example, in FIG. 17, the three-lobed cam 168 and triangular cam are fastly joined in dual cam 46 so that a radial line extending through the apex of each rounded corner 202 forms an angle 206 of sixty degrees with a radial line extending through the center of the camming surface of its trailing lobe 178 of the three lobed cam 168.

The distance 201 from the axis 171 to the center of a side wall 200 of the triangular cam 170 is less than the distance 203 from the axis 171 to the center of a rounded corner 202 of the triangular cam 170. The disclosed oven lock mechanism 30 capitalizes on this difference between distances 203 and 201 to move the torque arm 34 and the latch 32 coupled thereto with the triangular cam 170 to snug the oven door 12 to the frame 14 and compress the seal or gasket 24 prior to initiation of a self-cleaning cycle. As the triangular cam 170 is rotated, and the point of engagement between the torque arm 34 and the triangular cam 170 changes from a side wall 200 to a rounded corner 202, the torque arm 34 moves rearwardly a distance equal to the difference between the distances 203 and 201.

The oven lock mechanism 30 uses a dual cam 46 having a three lobed cam 168 fastly joined to a triangular cam 170 to facilitate transition between a latched and non-blocked state and a latched and blocked state with rotation of the cam 46 by only sixty degrees. Those skilled in the art will recognize that four lobed cam fastly joined to a square cam can be used within the scope of the disclosure. If such a combination dual cam is utilized, the distance the latch arm 34 moves rearwardly during rotation of the dual cam is not as great as is achieved with the disclosed dual cam 46. However, the square cam would only need to rotate forty-five degrees for a transition between a latched and non-blocked state and a latched and blocked state. Those skilled in the art will recognize that an X lobed cam fastly joined to a X sided polygon cam can be used within the scope of the disclosure (where X is a positive integer greater than one). As the number of sides and lobes on the dual cam increase, the amount of rotation required for a change of state decreases as does the effective compression of the seal 24 or pulling-in of the door.

As shown for example, in FIG. 18, the triangular cam 170 has a thickness 208 defined by the distance between its bottom surface 196 and its top surface 198. The bottom surface 196 of the triangular cam 170 and the top surface 182 of the three-lobed cam 168 are generally coplanar. The thickness 208 of the triangular cam 170 is such that when the dual cam 46 is mounted on the motor driven shaft 250 so that the top surface 198 of the triangular cam 170 is slightly below the bottom surface 270 of the mounting plate 52, then the bottom surface 196 of the triangular cam is slightly above the top surface 74 of the blockable arm 62 of the latch 32. Thus, the triangular cam 170 interacts with the torque arm 34 without interfering with the latch 32, and the three-lobed cam 168 interacts with the blocked member 76 of the latch 32 without interfering with the torque arm 34.

Figure 19:
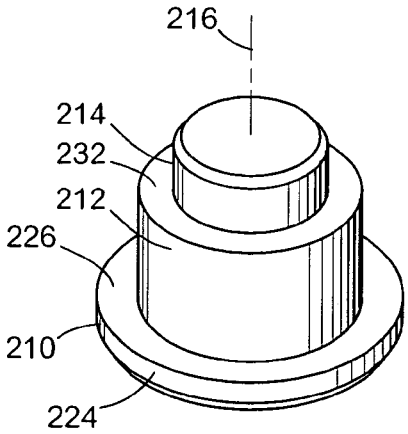
FIG. 19 is a perspective view of the slide shaft of FIG. 2.
Figure 20:
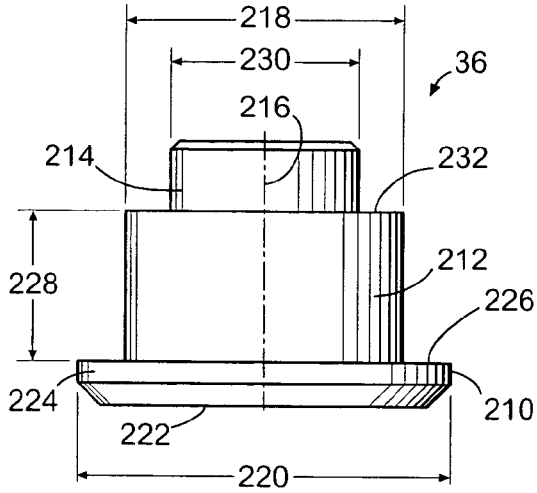
FIG. 20 is a side elevation view of the slide shaft of FIG. 19.

As shown, for example, in FIGS. 19 and 20, slide shaft 36 includes a head 210, a slot riding cylindrical shaft 212 and a pivot pin cylindrical shaft 214 formed concentrically about an axis 216. The head 210 of slide shaft 36 includes a top surface 222, a cylindrical side wall 224 and an annular flange 226. The cylindrical side wall 224 of the head 210 of slide shaft 36 has a diameter 218 greater than the width 308 of the slot 306 in the mounting plate 52. Slide shaft 36 reciprocates forwardly and rearwardly within the slot 306 in mounting plate 52. Thus, slot riding cylindrical surface 212 has a diameter 220 slightly less than the width 308 of the slot 306 in the mounting plate 52. The annular flange 226 extends between the cylindrical side wall 224 of the head 210 and the slot riding cylindrical wall 212 in a plane perpendicular to the axis 216. Thus, portions of annular flange 226 engage and slide along portions of the upper surface 272 of the mounting plate 52 adjacent to the slot 306.

The diameter 220 of the slot riding cylindrical surface 212 is also slightly less than the diameter of the mounting hole 148 in the torque arm 34 which is mounted on the slide shaft 36. The slot riding cylindrical surface 212 has a length 228 slightly less than the thickness of the mounting plate 52, the thickness of the torque arm 34, the length of the bosses 140, 142, 144, 146 extending from the torque arm 34 and the length of the bosses 68, 70 extending from the latch 32. Thus, slot riding cylindrical surface 212 can extend through the slot 306 of the mounting plate 52 and be received in the mounting hole 148 of the toque arm 34.

The pivot pin cylindrical shaft 214 has a diameter 230 less than the diameter of the pivot pin-mounting hole 66 in the latch 32. An annular flange 232 extends between the slot riding cylindrical shaft 212 and the pivot pin cylindrical shaft 214 in a plane perpendicular to the axis 216. When the pivot pin cylindrical shaft 214 is received in the mounting hole 66 in the latch 32, a portion of the top surface 74 of the latch 32 adjacent the mounting hole 66 may ride on the annular flange 232 during rotation of the latch 32 about the pivot axis 216.

Figure 21:
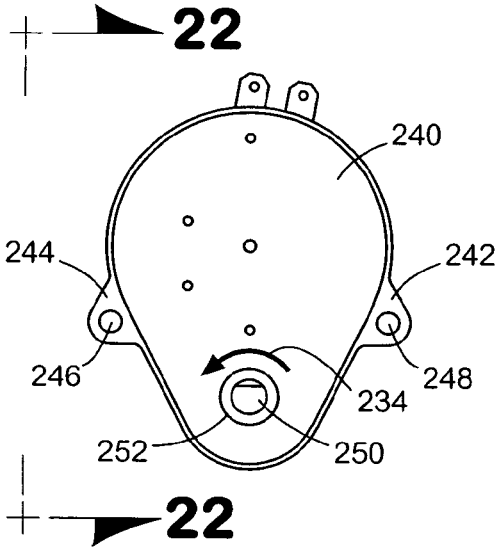
FIG. 21 is a plan view of the motor and gear box of FIG. 8.
Figure 22:
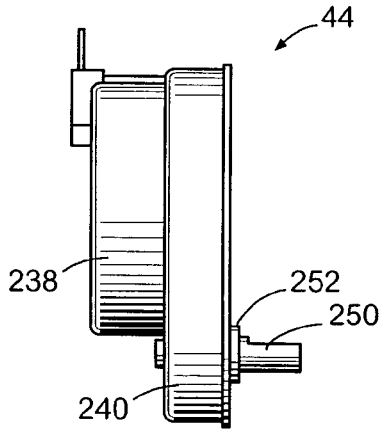
FIG. 22 is a side elevation view of the motor and gear box taken along line 22—22 of FIG. 21.

As shown, for example, in FIGS. 21 and 22, the motor and gear box 44 includes a motor 238, a gear box 240, mounting flanges 242, 244 formed to include mounting holes 246, 248, a D-shaped shaft 250 and a shaft bearing 252. Motor 238 is illustratively a synchronous induction AC high torque ODL class "F" motor. Motor and gear box 44 operate at 3 RPM in response to a 120 VAC, 60 Hz signal. Illustratively, motor has a 130 IN-OZ (0.92 Nm) minimum start and stall torque at 3 RPM over the operating range of 90V to 130V.

The disclosed motor and gearbox 44 is used in both of the oven lock mechanism 30 and the oven lock mechanism 430. Mounting hole 248 in mounting flange 242 is sized to receive a mounting pin 328 extending upwardly from the top surface 272 of the mounting plate 52 or a fastener 731. Mounting hole 246 in mounting flange 244 is sized to receive a fastener such as a rivet 254 or fastener 733 which also extends through a corresponding motor mounting hole 330, 730 on the mounting plate 52 or rear mounting plate 453, respectively. When the motor and gear box 44 are mounted to the top surface 272 of the mounting plate 52, the motor driven D-shaped shaft 250 and the shaft bearing 252 are centered within the motor shaft-receiving hole 326 in the mounting plate 52. The dual cam 46 is mounted on the D-shaped shaft 250 with the D-shaped shaft 250 being received in the D-shaped motor shaft-mounting bore 172 and a portion of the shaft bearing 252 being received in the counter bore 176. Thus, rotation of motor 238 through the gear box 240 drives the shaft 250 and the dual cam 46 attached thereto.

Similarly, when the motor and gear box 44 are mounted to the bottom surface 273 of the rear mounting plate 453, the motor driven D-shaped shaft 250 is centered within the motor shaft-receiving hole 726 in the mounting plate 453. The cam 446 is mounted on the D-shaped shaft 250 with the D-shaped shaft 250 being received in the D-shaped motor shaft-mounting bore 572. Thus, rotation of motor 238 through the gear box 240 drives the shaft 250 and the cam 446 attached thereto.

Figure 23:
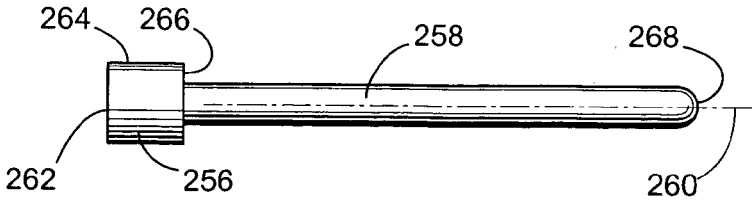
FIG. 23 is a plan view of the actuator pin of FIG. 2.
Figure 24:
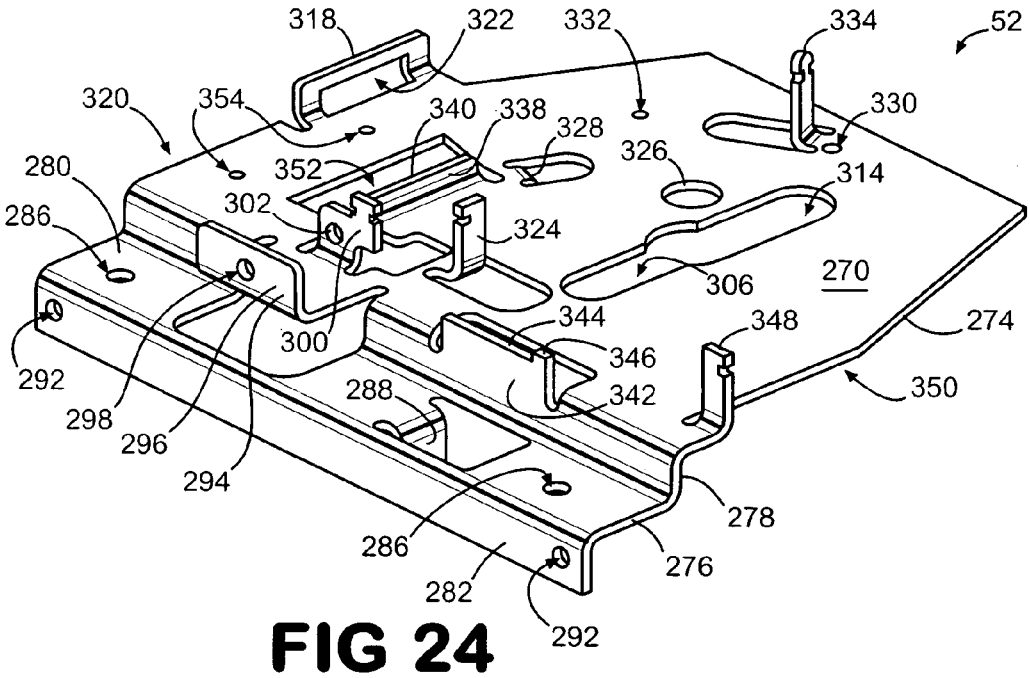
FIG. 24 is a perspective view of the mounting plate of FIG. 2.
Figure 25:
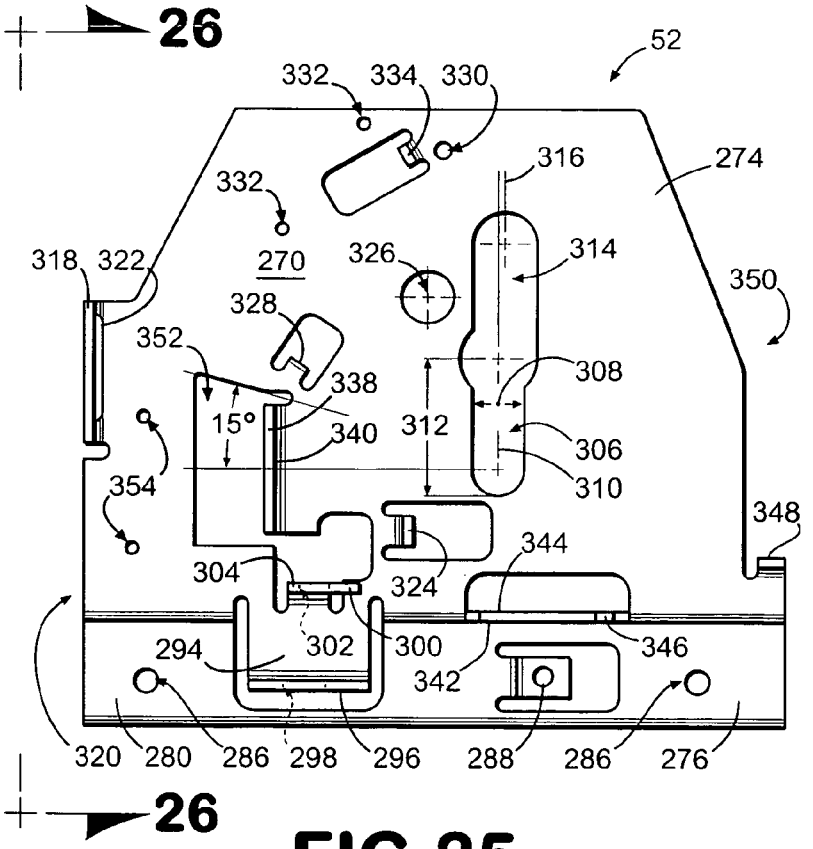
FIG. 25 is a plan view of the mounting plate of FIG. 24.

The disclosed actuator pin 38 is used in both of the oven lock mechanism 30 and the oven lock mechanism 430. As shown for example, in FIG. 23, the actuator pin 38 includes a head 256 and a shaft 258 formed concentrically about an axis 260. The head 256 of the actuator pin 38 includes a circular cam surface 262, a cylindrical wall 264 and an annular ring 266. The annular ring 266 extends inwardly from the cylindrical wall 264 in a plane perpendicular to the axis 260 to couple the head 256 to the shaft 258. The shaft 258 is generally cylindrical-shaped except that it includes a rounded end 268 for engaging the inner face 20 of the oven door 12.

The shaft 258 has a diameter slightly smaller than the diameter of the shaft-receiving apertures 298, 302 formed in the actuator-mounting brackets 294, 300 respectively. The cylindrical wall 264 has a diameter slightly large than the diameter of the shaft-receiving hole 300 in the actuator bracket 302 so that annular ring 266 engages the rear surface 304 of the bracket 300 to stop forward movement of the actuator pin 38. The cam surface 262 engages the arcuate follower surface 98 of the follower arm 58 of the latch 32 and, in response to an axial force exerted on the rounded end 268 of the shaft 258, urges the follower arm 58 to rotate about the pivot axis 216.

Similarly, when the actuator pin 38 is used in the oven lock mechanism 430, the shaft 258 has a diameter slightly smaller than the diameter of the shaft-receiving apertures 698, 702 formed in the front lip and actuator-mounting bracket 700. The cylindrical wall 264 has a diameter slightly large than the diameter of the shaft-receiving hole 702 in the actuator bracket 700 so that annular ring 266 engages the rear surface 704 of the bracket 700 to stop forward movement of the actuator pin 38. The cam surface 262 engages the arcuate follower surface 498 of the follower arm 458 of the latch 432 and, in response to an axial force exerted on the rounded end 268 of the shaft 258, urges the follower arm 458 to rotate about the pivot axis 616.

The illustrated mounting plate 52 is stamped and formed from a single sheet of metal such as nickel electroplated bright nickel. The mounting plate 52 includes essentially two regions, a substantially planar component mounting portion 274 and an offset oven mounting portion 276.

The oven mounting portion 276 includes an offset leg 278, a horizontal leg 280 and a lip 282. The offset leg 278 is coupled to the front of and extends upwardly from the component mounting portion 274. The horizontal leg 280 is coupled to and extends forwardly from the top of the offset leg 278. The offset leg 278 has a length that provides sufficient offset between the top 26 of the oven frame 14 and the bottom surface 270 of the component mounting portion 274 of the mounting plate 52 to facilitate mounting the latch 32, the torque arm 34 and the cam-actuated switch 48 to the bottom surface 270 of the component mounting portion 274. The horizontal leg 280 includes two mounting holes 286 through which fasteners (not shown) are received for mounting the mounting plate 52 to the top surface 26 of the oven frame 14. An L-shaped mounting leg 288 extends upwardly from the horizontal leg 280 for coupling to the underside of the cook top 18 of the oven 10. The upwardly-extending lip 282 is coupled to and extends upwardly from the front edge of the horizontal leg 280. The front surface 290 of upwardly-extending lip 282 contiguously engages the frame 14 of the oven 10 as shown, for example, in FIGS. 2–6. The upwardly-extending lip 282 is formed to include two mounting holes 292 through which fasteners (not shown) extend to mount the mounting plate 52 to the oven frame 14.

The component mounting portion 274 is substantially planar. A plurality of brackets, flanges, legs and fingers extend from the bottom surface 270 and the top surface 272 of the component mounting portion 274 to facilitate mounting various components to the mounting plate 52. The mounting plate 52 is also formed to include various apertures through which portions of mounted components extend.

The mounting plate 52 is formed to facilitate mounting the actuator pin 38 thereto for reciprocal forward and rearward movement. An L-shaped actuator-mounting bracket 294 extends forwardly and downwardly from the front edge of the component mounting portion 274. The downwardly extending leg 296 of the L-shaped bracket 294 is formed to include a shaft-receiving aperture 298 extending between its front surface and rear surface. A rear actuator-mounting bracket 300 extends downwardly from the bottom surface 270 of the component mounting portion 274. Rear actuator-mounting bracket 300 is formed to include a shaft-receiving aperture 302 extending between its front surface and rear surface. As shown, for example, in FIGS. 2–6 and 24, the shaft-receiving apertures 298, 302 of the front and rear mounting brackets 294, 300, respectively, are aligned to permit the shaft 258 of the actuator pin 38 to reciprocate forwardly and rearwardly therethrough.

When the actuator pin 38 is mounted to the mounting plate 52, the shaft 258 of the actuator pin 38 is received in the shaft-receiving apertures 298, 302. The rear surface 304 of the rear actuator-mounting bracket 300 engages the annular wall 266 of the actuator pin head 256 to act as a stop against forward reciprocal movement.

The mounting plate 52 is also configured to facilitate mounting the torque arm 34 to the mounting plate 52 for forward and rearward reciprocal movement of the torque arm 34 with respect to the mounting plate 52. The mounting plate 52 is formed to include a slot 306 having a width 308 substantially equal to the diameter 220 of the slot-riding surface 212 of the slide shaft 36. Slot 306 has a longitudinal axis 310 about which it is symmetrically formed. Slot 306 has a length 312 greater than the sum of the diameter 220 of the slot riding cylindrical shaft 212 of the slide shaft and the difference between the distance 203 from the axis 171 of the dual cam 46 to the center of a rounded corner 202 of the triangular cam 170 and the distance 201 from the axis 171 of the dual cam 46 to the center of a side wall 200 of the triangular cam 170. Slide shaft 36 is received in the slot 306. The torque arm 34 and the latch 32 are mounted to the mounting plate 52 through the slide shaft 36. Portions of the inner annular face 226 of the head 210 of the slide shaft 36 engage the top surface 272 of the mounting plate 52 adjacent the slot 306. Thus, the torque arm 34 mounted on the slide shaft 36 reciprocates forwardly and rearwardly guided by the slot 306 with respect to the mounting plate 52.

An access slot 314 symmetrically formed about a longitudinal axis 316 off-set from the longitudinal axis 310 of slot 306 intersects with slot 306. The access slot 314 provides access to the portions of the cam 46 to facilitate unlocking the lock mechanism 30 in the event of failure.

A downwardly extending flange 318 stamped along a portion of the side 320 of the mounting plate 52 is formed to include an arm-receiving channel 322. The arm-receiving channel 322 receives the cantilevered arm 136 of the torque arm 54 and guides forward and rearward movement of the arm 136. The flange 318 in which the arm-receiving channel 322 is formed inhibits out of plane rotation of the torque arm 34 by engaging the bottom surface 130 of the cantilevered arm 136.

A torque arm bias spring anchor finger 324 extends downwardly from near the front edge of the component mounting portion 274 of the mounting plate 52. The mounting plate end 43 of the torque arm bias spring 42 is attached to the torque arm bias spring anchor finger 324. The torque arm end 41 of the torque arm bias spring 42 is attached to the spring anchor finger 138 on the torque arm 34. The torque arm bias spring 42 biases the torque arm 34 toward the front of the mounting plate 52 so that the slide shaft 36 is urged toward the front of the slot 306.

When the torque arm 34 is mounted to the mounting plate 52, the distal end 166 of the cantilevered arm 136 of the torque arm 34 is received in the arm-receiving channel 322 formed in the downwardly extending flange 318 along a portion of the side 320 of the mounting plate 52. The slide shaft 36 is received in the slot 306 and the slide shaft-mounting hole 148 of the torque arm 34 to couple the torque arm 34 to the mounting plate 52. The torque arm 34 and slide shaft 36 are configured to slide inwardly and outwardly guided by the slot 306. The torque arm bias spring 42 is coupled between the anchor finger 138 on the torque arm 34 and the anchor finger 324 on the mounting plate 52 to bias the torque arm 34 forward so that the slide shaft 36 is disposed near or in engagement with the front wall of the slot 306. When so mounted, the cam-receiving aperture 150 in the torque arm 34 is positioned under the motor shaft-receiving hole 326 in the mounting plate 52. This mounting arrangement facilitates actuation by the triangular cam 170 of the dual cam 46 of reciprocal movement of the torque arm 34 with respect to the mounting plate 52.

The mounting plate 52 is configured to facilitate mounting the motor and gearbox 44 and the dual cam 46 in a fixed position relative to the mounting plate 52. The motor and gearbox 44 and the cam 46 are mounted in a position so that the surfaces 200, 202 of the triangular cam 170 interact with surfaces 152, 154, 156, 158, 160, 162 of the cam-receiving aperture 150 of the torque arm 34 and the three lobed cam 168 interacts with the blocked member 76 of the latch 32 and a contact button 47 of the cam-actuated switch 48. Thus, the mounting plate 52 includes a motor shaft-receiving hole 326 positioned to overlie the location at which the cam-receiving aperture 150 of the torque arm 34 is located when the torque arm 34 is mounted to the mounting plate 52. The motor shaft-receiving hole 326 is sized to permit the motor driven shaft 250 and shaft bearing 252 to extend therethrough and rotate therein without engaging the walls of the hole 326.

A motor mount pin 328 sized to be received in a mounting hole 248 on the flange 242 of the motor and gearbox 44 extends upwardly from the top surface 272 of the mounting plate 52. A motor mounting hole 330 extends through the mounting plate 52 through which a fastener, such as rivet 254, is received to mount the motor and gear box 44 to the mounting plate 52. The motor mounting hole 330 and the motor mount pin 328 are disposed on the mounting plate 52 to facilitate mounting motor and gearbox 44 to the mounting plate 52. When the mount pin 328 extends through the mounting hole 248 and a fastener 254 extends through the mounting hole 246 and the motor mounting hole 330, the motor driven shaft 250 is disposed in the center of the shaft-receiving hole 326. Dual cam 46 is mounted on the motor driven shaft 250 to interact with the torque arm 34 and the blocked member 76 of the latch 32.

Figure 26:
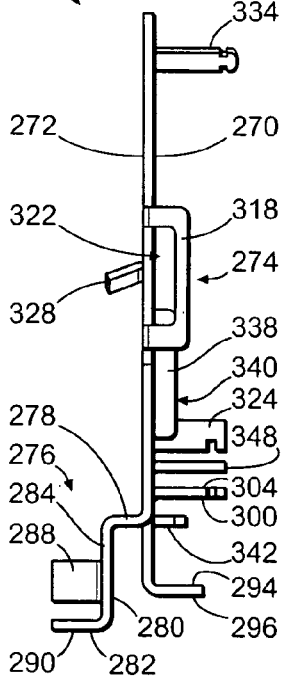
FIG. 26 is a side elevation view of the mounting plate taken along line of 26—26 of FIG. 25.

The mounting plate 52 is configured to facilitate mounting the cam-actuated switch 48 on the mounting plate 52 at a location in which the cam 46 engages the contact button 47 of the switch 48. The mounting plate 52 is formed to include two switch mounting holes 332 and a switch stop 334 that engages one end of switch 48. Switch stop 334 extends downwardly from the bottom surface 270 of component portion 274 of the mounting plate 52, as shown, for example, in FIGS. 26–28. Fasteners 336 (FIG. 2) extend through the switch mounting holes 332 and mounting holes (obscured by fasteners 336) on the cam-actuated switch 48 to secure the switch 48 to the mounting plate 52. The mounting holes 332 and the switch stop 334 are positioned and configured to place the contact button 47 of the cam-actuated switch 48 where it can be actuated by any of the lobes 178 of the three lobed cam 168 during rotation of the dual cam 46.

The mounting plate 52 is configured to facilitate mounting the latch 32 so that it can assume a non-latching, latching and pulled-in position. As has been previously stated, the latch 32 is not directly mounted for pivoting about a fixed pivot point relative to the mounting plate 52. Rather the latch 32 is mounted to pivot about a fixed pivot axis 216 relative to the torque arm 34 which pivot axis 216 moves reciprocally with respect to the mounting plate 52. This is possible because the latch 32 is mounted through the slide shaft 36 and torque arm 34 indirectly to the mounting plate 52.

To maintain portions of the latch 32 substantially parallel to both the mounting plate 52 and the torque arm 34, portions of the latch 32 engage various surfaces on the mounting plate 52. Thus mounting plate 52 is formed to include a follower arm riding surface 338 on the bottom surface of a lip 340 extending downwardly from the bottom surface 270 of the mounting plate 52, as shown, for example, in FIGS. 2, 26–28. The mounting plate 52 is also formed to include a latch arm riding flange 342 extending downwardly from the bottom surface 270 of the mounting plate 52. Latch arm riding flange 342 includes a riding surface 344 and a stop 346 extending downwardly from the riding surface 344. When latch 32 is mounted to and suspended pivotally below the torque arm 34, the top surface of follower arm 58 rides on the follower arm riding surface 338 and the top surface of the latch arm 60 rides on the latch arm riding surface 344. Rotation of the latch 32 in a counter-clockwise direction (as seen from above) is limited by the outside wall 116 of the latch arm 60 coming into engagement with the stop 346.

The mounting plate 52 is formed to ensure that the latch 32 is in a position in which the follower surface 98 of follower arm 58 is positioned to engage the cam surface 262 of the head 256 of actuator pin 38. The mounting plate 52 is also formed to ensure that the blocked member 76 of the latch 32 is positioned below the triangular cam 170 of the dual cam 46 in a position to be engaged by a lobe 178 of the three-lobed cam 168 when the latch 32 is in the latched position. Thus, the blocked member 76 is positioned to be selectively blocked and non-blocked by one of the three lobes 178 of the dual cam 46.

The mounting plate 52 includes a latch spring anchor finger 348 extending downwardly from the bottom surface 270 of one side 350 of the mounting plate 52. The mounting plate end 39 of latch bias spring 40 is coupled to the latch spring anchor finger 348 and the latch end 37 of the spring 40 is coupled to the bias spring anchor finger 128 on the latching arm 60 of the latch 32. The spring 40 biases the latch 32 toward the unlatched position.

The mounting plate 52 is formed to include an aperture 352 through which the offset switch actuator arm 100 of the follower arm 58 extends when the latch 32 is mounted on the slide shaft 36. Offset actuator arm 100 is an L-shaped arm that extends upwardly and beyond the end 102 of the follower arm 58 of the latch 32. L-shaped arm 100 includes an actuator surface 110 that selectively engages and actuates the contact button 49 of the latch-actuated switch 50. Two mounting holes 354 are formed adjacent aperture 352 for mounting switch 50 to the top surface 272 of the mounting plate 52. Fasteners 356 extend through the mounting holes 354 and mounting holes (obscured by fasteners 356) on the switch 50 to mount the switch 50 to the mounting plate 52.

The design of oven lock mechanism 30 provides significant advantages during production of self cleaning ovens 10. In particular, every oven 10 that travels through an assembly line must be tested by placing the oven 10 in a lock mode and verifying that it is locked, and then placing the oven 10 in an unlocked mode, and verifying that the oven 10 is unlocked. With use of the oven lock mechanism 30, the oven locks in 3.3 seconds, and then unlocks in another 3.3 seconds. With previous motor driven oven door locks, each lock and unlock event took 15.0 seconds. The time savings achieved by oven lock mechanism 30 results from the motor and gearbox 44 only being required to turn the cam 46 sixty degrees for each door lock and unlock event, in comparison to 180° with prior door locks. With the high volume of ovens 10 that must be tested in the above manner, use of an oven lock mechanism 30 results in significant time savings.

The disclosed oven lock mechanisms 30, 430 ensure that the oven door lock operates properly even in situations where the oven door 12 does not normally close up tight against its corresponding frame 14. Such a lack of tight closure may occur as the result of the presence of an extra thick seal 24 when a new seal is present or as the result of a slightly bent or warped door 12. The disclosed oven lock mechanisms 30, 430 eliminate mechanical play (i.e. physical movement) between the oven door 12 and the frame 14 when the oven 10 is placed in the self-clean mode of operation and a user attempts to pull it open. The oven door 12 is snugly urged against the frame 14 by the door lock mechanisms 30, 430 to eliminate jiggling. Tolerance stackup in the parts that are mechanically interposed between the latch 32, 432 and the motor 44 traditionally are a source of this jiggling problem. This disclosure describes oven lock mechanisms 30, 430 that are designed to ensure that the oven door 12 is sealed against the door gasket 24. In other words, the oven lock mechanisms 30, 430 cause the latch 32, 432 to actually pull the door up tight against the door gasket 24.

A second embodiment of an oven door lock mechanism 430 provides the same advantages as the first embodiment 30 described above. As shown, for example, in FIGS. 27–46, the second embodiment of an oven lock mechanism 430 shares many features in common with the first embodiment of the oven lock mechanism 30. Thus, similar reference numerals (typically in a series 400 higher than used in describing the first embodiment) will be used in describing the second embodiment of the oven lock mechanism 430 as were used in describing the first embodiment of the oven lock mechanism 30. Where components are identical, the same reference numerals will be used in describing the embodiment of the oven lock mechanism 430 as were used in describing the first embodiment of the oven lock mechanism 30. Generally speaking, however, only motor and gear box 44 and the actuator pin 38 are identical in both embodiments.

While switches 48, 50, 448, 450 may appear to be identical, the switches 448, 450 used in the second embodiment of the oven lock mechanism 430 need not be as heat resistant as the switches 48, 50 used in the first embodiment of the oven lock mechanism 30. Thus switches 448, 450 may be substantially cheaper than switches 48, 50. The ability to use cheaper less heat tolerant switches is one of the motivating factors behind the design of the oven lock mechanism 430 which locates the switches 448, 450 in a location where less heat is typically present in an oven 10.

The second embodiment of the oven lock mechanism 430 can be viewed fairly accurately as an effort to move all of the more heat sensitive components and the actuators therefor to the back of the oven 10 away from the high heat often experienced at the front of the oven 10 near the interface of the door 12 and the abutment surface 22 of the frame 14. A long rod or linkage 454 couples the latch 432 to the lever member 462. The lever 462 in essence replaces the blockable arm 62 and the offset switch actuator leg 100 of the follower arm 58 of the first embodiment 30. The latch 432 is located in the high temperature region at the front of the oven 10 to be able to retain the oven door 12 in a locked position when the oven 10 is placed in a self-cleaning mode of operation. The lever member 462 is located in a lower temperature region near the rear of the oven 10 since it actuates, by physical contact, switch 450 that is temperature sensitive and thus needs to be located in the lower temperature rear of the oven 10.

Similar to the first embodiment that used a three lobed cam 168 of a dual cam 46 as a blockout member, the second embodiment 430 utilizes a cam 446 configured to include a three lobed cam 568 as blockout member to prevent rotation of the latch 432 from the latched to the unlatched position during a self-cleaning cycle. However, rather than directly engaging an arm of the latch, the cam 446 engages a blocked element 476 on the end of lever 462 coupled by the rotary push rod 454 to the latch 432. The follower surface 480 of the blocked member 476 of the lever 462 is positioned and configured so that the rotation of cam 446 by the motor and gear box 44 removes any surplus slack or mechanical play from the mechanical linkage (i.e. the lever 462, the rotary push rod 454, and the latch 432).

As shown, for example in FIGS. 27–30, the second embodiment of a motorized oven lock 430 is configured for mounting in a self cleaning oven 10. The oven 10 is virtually identical to oven 10 described in conjunction with the first embodiment. As shown, in FIG. 27, oven 10 does not differ between the two embodiments rather the oven lock mechanism 30 or 430 mounted to the oven 10 differs as does the location or locations of mounting the oven lock mechanisms 30, 430 on the oven 10. In the first embodiment, the oven mount mechanism 30 is mounted on a single mounting plate 52 at the top front of the oven. In the second embodiment, the components of the oven lock mechanism 430 are mounted on two mounting plates 451, 453. One mounting plate 451, on which less heat sensitive components are mounted, is mounted at the top front of the oven 10. The remainder of the components, including the more heat sensitive components, is mounted on a rear mounting plate 453 at the top rear of the oven 10.

As shown for example in FIGS. 28–32, a second embodiment of a motorized oven lock mechanism 430 includes a latch 432, a rotary push rod 454, a latch pivot pin 436, an actuator pin 38, a latch bias spring 440, a motor and gear box 44, a cam 446, a cam-actuated switch 448, a lever actuated switch 450, a front mounting plate 451, a rear mounting plate 453, a lock out lever 462 and a lock out lever pivot pin 456.

The latch 432, latch pivot pin 436, actuator pin 38 and one end of the rotary push rod 454 are coupled or mounted to the front mounting plate 451. All of these components in the illustrated oven lock 430 are made of metal, such as polished nickel, and are very heat tolerant. The rounded end 268 of the actuator arm 38 and the latching member 520 of the 432 are exposed forward at the abutment surface 22 of the frame 14 that interfaces with the inside face 20 of the oven door 12. When the oven door 12 is closed, the inside face 20 of the door 12 engages and depresses the actuator pin 38. The actuator pin 38 depresses against the latch 432 and rotates the latch 432 to a position that traps the door 12.

Rotational movement of the latch 432 is transferred through rotary rod 454 to the lockout lever 462 mounted on the rear mounting plate 453. The lever actuated switch 450 is activated by rotation of the lever 462 induced by the rotation of the latch 432 to the latched position. Upon being activated, the lever-actuated switch 450 enables the self-cleaning function of the oven 10. If self-cleaning is selected, typically by a user actuating a switch on the oven control panel, a circuit is closed driving the motor and gear box 44 to rotate the cam 446. The cam 446 rotates to a position that traps the lever 462 in a blocked position. During rotation of the cam 446 to the blocked position, the cam 446 becomes disengaged from the contact button 447 of the normally open cam-actuated switch 448. The cam-actuated switch 448 controls the proper position of the cam lobes 578. Cam-actuated switch 448 signals to the electronic package a change in state.

As shown, for example, in FIGS. 28–32, oven lock mechanism 430 includes an actuator pin 38 that is moved against a spring bias exerted by the latch bias spring 440 to a depressed position every time the oven door 12 is closed. In response to this action, the latch 432 is advanced into a latched position regardless of whether or not the oven 10 is to be placed in a self-cleaning mode of operation. When a user does place the oven 10 in the self-cleaning mode, an oven controller actuates the motor and gear box 44 to drive the cam 446 that acts as a block out member to a blocking position. When cam 446 is placed in such blocking position, any attempt to open the oven door 12 will be unsuccessful since the block out member is positioned to prevent the lever 462 coupled by the push rod 454 to the latch 432 from pivoting back to its unlatched position. Once the self-cleaning cycle is completed, the oven controller actuates the motor and gear box 44 to drive the cam 446 back to a non-blocking position. When placed in such non-blocking position, an attempt to open the oven door 12 is successful since the cam 446 is positioned to allow the lever 462 to pivot freely thus allowing the latch 432 to freely pivot back to its unlatched position.

More particularly, the front mounting plate 451 of the oven lock mechanism 430 is mounted to the top front of the oven frame 14. The front mounting plate 451 of the oven lock mechanism 430 is positioned relative to the frame 14 so that the latching arm 460 of the latch 432 and the rounded end 268 of the shaft 258 of the actuator pin 38 extend forwardly beyond the abutment surface 22 of the oven frame 14 when the oven door 12 is opened. This is to permit the oven door 12 to engage the rounded end 268 of the actuator pin 38 during closing to urge the pin 38 to reciprocate rearwardly to urge the latch 432 into a latching position.

As shown, for example, in FIGS. 28–32, the latch 432 is mounted to the front mounting plate 451 for pivotal movement about the pivot axis 616 for movement between the latched position and an unlatched position. The latch 432 is coupled by the rotary push rod 454 to the lock-out lever 462. The lock-out lever 462 is pivotally mounted to the rear mounting plate 453. Rotation of the latch 432 into the latched position induces rotation of the lever 462 to a non-blocked latched position, as shown, for example, in FIG. 29. As the cam 446 rotates to engage the follower surface 480 of the lever 462 is urged to rotate even farther in a counter-clockwise direction to a blocked position. This additional rotation of the lever 462 is transferred through the rotary push rod 454 to the latch 432 which pulls against the oven door 12 to "snug" the oven door 12. Pulling-in involves taking up any mechanical slack from tolerance build up between the parts and compressing the seal 24 between the inner surface 20 of the door 12 and the abutment surface 22 of the frame 14. The non-cleaning latched position or non-blocked latched position, is shown, for example, in FIG. 29 and the cleaning latched position, blocked position or pulled-in position is shown, for example, in FIG. 30.

Figure 27:
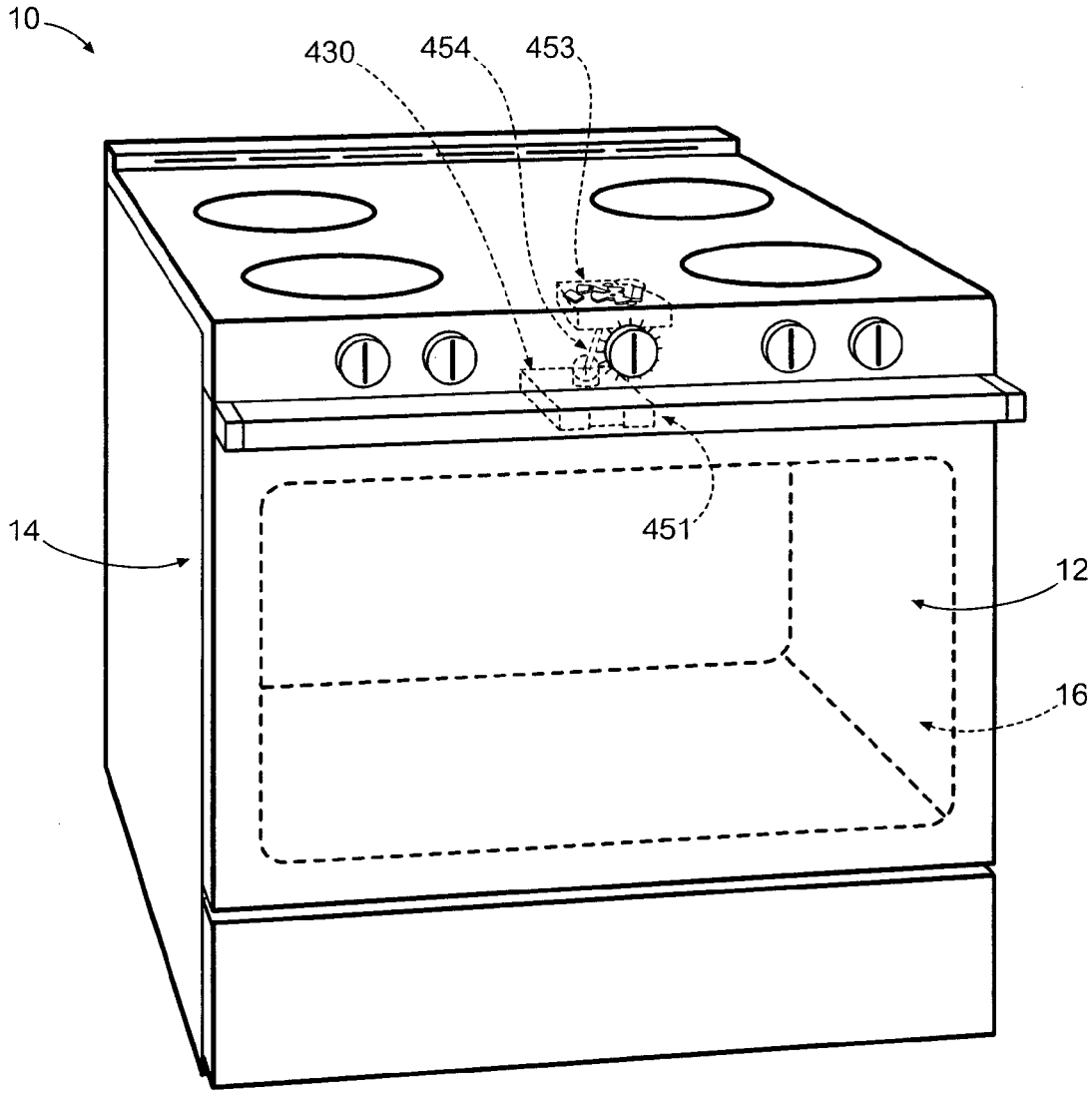
FIG. 27 is a perspective view of a self cleaning oven with the oven door closed and a second embodiment of the oven lock mechanism shown in phantom lines, a portion of which is mounted at the front of the oven frame above the cooking chamber and below the cook top and a second portion of which is mounted at the rear of the oven chamber below the cook top with a rod extending between and coupling the two portions.
Figure 28:
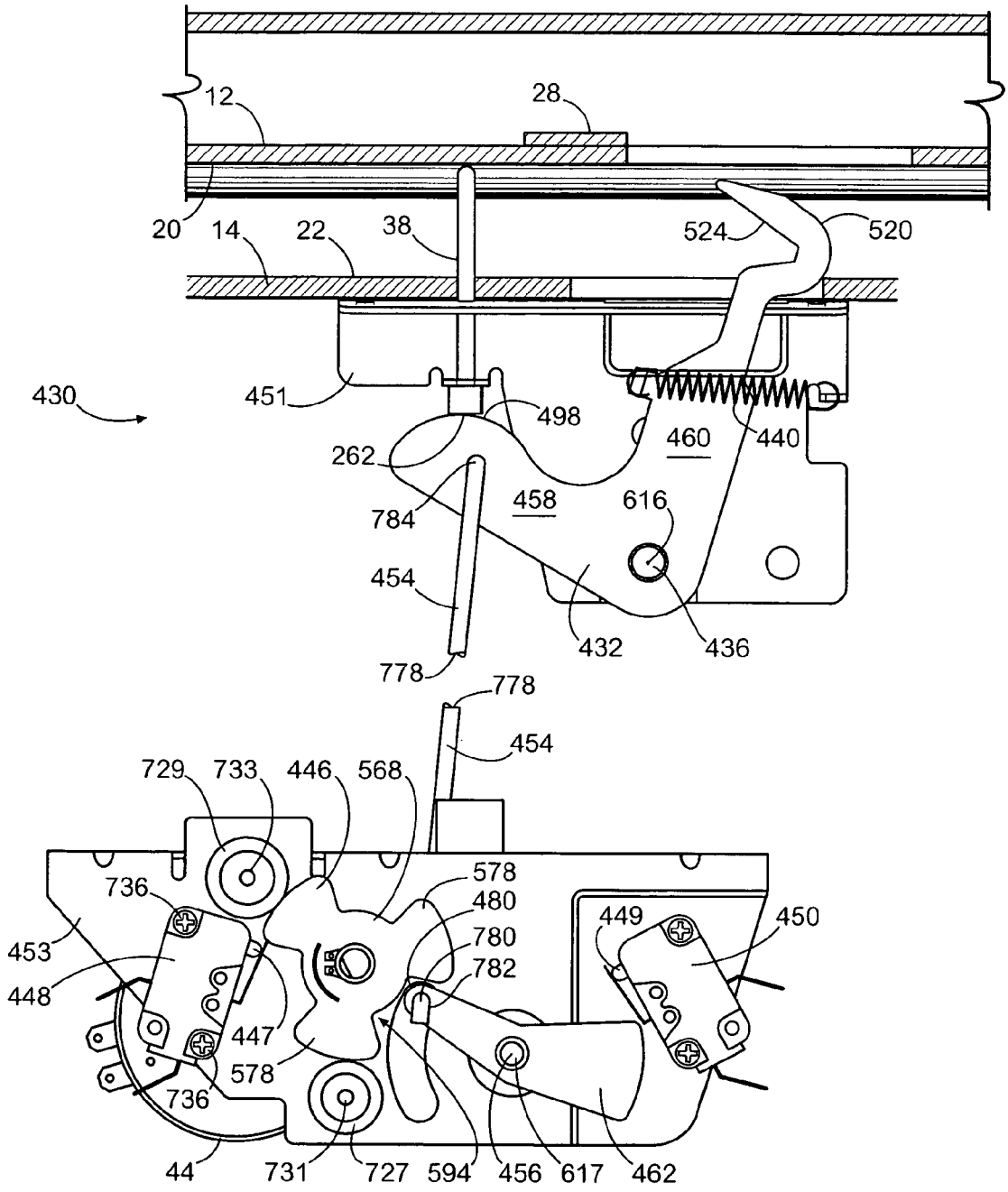
FIG. 28 is a plan view with the cook top of the oven broken away of the oven lock mechanism and the oven of FIG. 27 with the door of the oven open sufficiently to permit the latch of the oven lock mechanism to assume its normal unlocked position.
Figure 29:
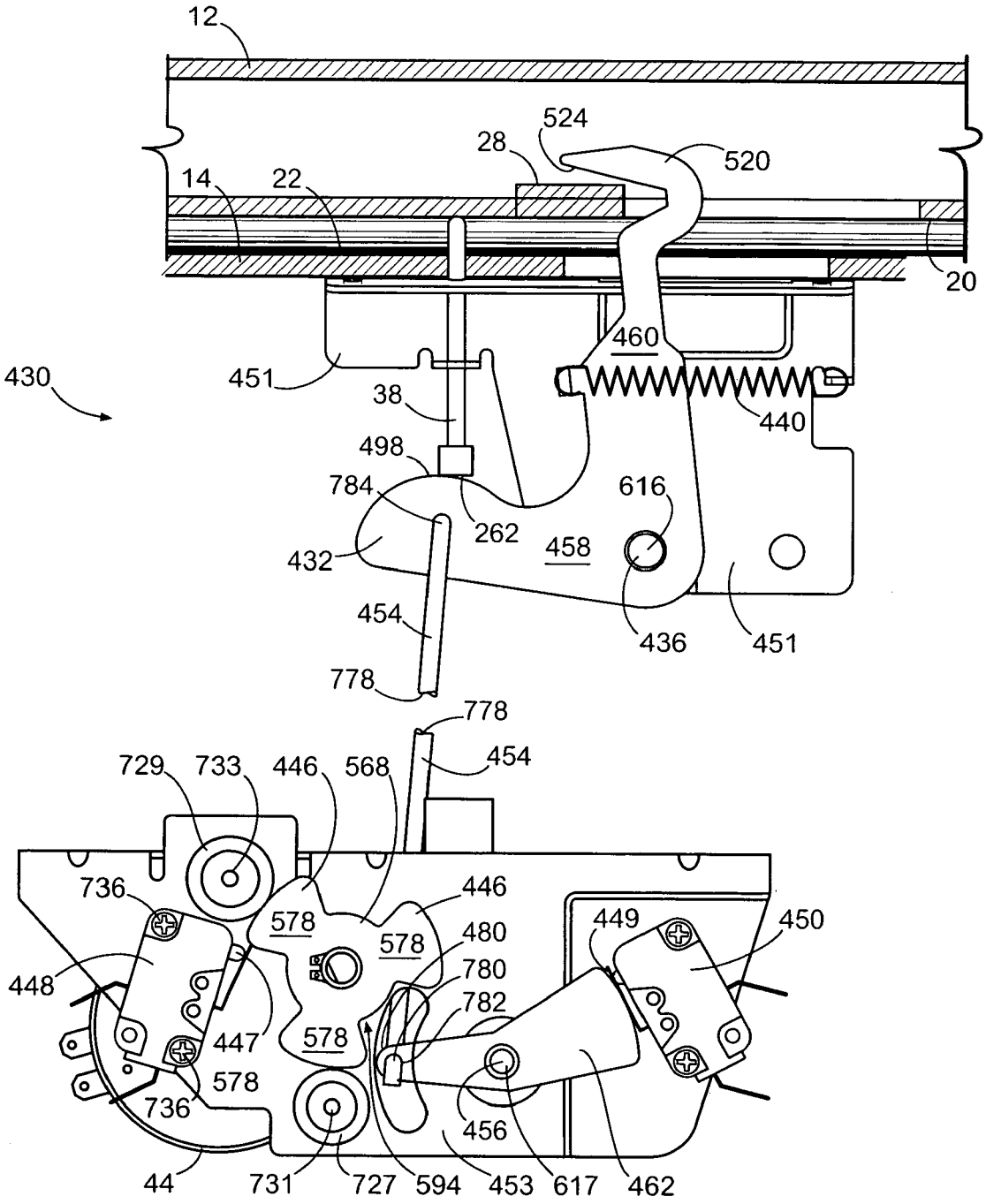
FIG. 29 is a plan view similar to FIG. 28 with the oven door closed resulting in the latch of the oven lock mechanism being urged into a latched position.

The rear mounting plate 453 is rigidly mounted to the top rear of the oven frame 14 as shown, for example, in FIG. 27. The motor and gear box 44 are mounted to the rear mounting plate 453 so that its shaft 250 extends through a motor shaft-receiving hole 726 formed in the rear mounting plate 453. The cam 446 is mounted to the shaft 250 so that the three lobed cam shaft 568 is positioned to engage the lock-out lever 462 upon rotation of the motor and gear box 44. When the oven door 12 is open (FIG. 28), or when the door 12 is closed and a cleaning cycle has not been initiated (FIG. 29), the three lobed cam 568 is positioned such that none of the lobes 578 interferes with rotational movement of the lever 462 and the blocked member 476 is free to pivot into and out of a void 594 between two of the cam lobes 578.

When the door 12 closes, the door 12 engages the rounded end 268 of the shaft 258 of the actuator pin 38 and urges the actuator pin 38 rearwardly. The cam surface 262 on the head 256 of the actuator pin 38 is pushed against the arcuate follower surface 498 of the follower arm 458 of the latch 432 inducing counter-clockwise (as seen from the top) rotation of the latch 432 about the latch pivot pin 436. The counter-clockwise rotation causes the latch bias spring 440 to be stretched to store a restorative force for returning the latch 432 to an unlatched position. Counter-clockwise rotation of the latch 432 accomplishes at least three things. First, the latching arm 460 is pivoted to within a slot in the door 12 of the oven 10 to a position in which the engaging wall 524 of the latching member 520 is adjacent to a striker plate 28 in the oven door 12. In this position, the latch 432 would prohibit outward movement of the door 12. Second, the blocked member 476 of the lock-out lever 462 is pivoted out of one of the sixty degree voids 594 between lobes 578 of the three-lobed cam 568 of the cam 446. Third, the switch actuator surface 510 at the end 512 of the lockout lever 462 is moved to a position in which it no longer engages the lever actuated switch 450.

Lever actuated switch 450 can also be referred to as the motor electrical actuator switch 450 because, when the contact button 449 is released by clockwise rotation of the switch actuator surface 510, switch 450 permits current flow to the motor and gear box 44. Thus, movement of the latch 32 into the latched position moves the lever 464 into a position to enable the motor and gear box 44 which may then move the cam 446 to a blocking position upon receipt of a signal initiating a cleaning cycle. When in the blocking position, the cam surface 588 of one of the three lobed-cams 578 of the cam 446 engages the follower surface 480 on the end of the blocked member 476 of the lock-out lever 462 preventing clockwise rotation of the lever 462 and the latch 432 coupled thereto by the rotary push rod 454.

Not only does the disclosed oven lock mechanism 430 block the latch 432 from rotating from a latched position to an unlatched position after a cleaning cycle initiation signal has been received, but it also moves the latch 432 into a pulled-in position in which the gasket or seal 24 disposed between the oven door 12 and the abutment surface 22 is compressed as the door 12 is pulled into a more snug engagement with the abutment surface 22. Clockwise rotation of the cam 446 causes the three lobed cam 568 to place the camming surface 588 of one of its lobes 578 into engagement with the follower surface 480 of the blocked member 476 inducing additional rotation of the lever 462 which induces additional rotation of the latching member 520. During this additional rotation, the engaging wall 524 of the latch 432 engages the striker plate or inner wall 28 of the oven door 12 and pulls the oven door 12 rearwardly causing the seal 24 to be compressed between the oven door 12 and the abutment surface 22 of the frame 14.

After cam 446 rotates sixty degrees, the lobe 578 previously actuating the contact button 447 of the cam-actuated switch 448 rotates to a position in which the contact button 447 is released. Upon release of the contact button 447, a timer circuit (not shown) is initiated and further rotation of the motor and gear box 44 and the cam 446 attached thereto is locked out until the timer expires indicating the end of the cleaning cycle.

At the end of the cleaning cycle, the cam 446 again rotates sixty degrees. Thus, the three lobed cam 568 moves to a position in which the follower surface 480 of the lock-out lever 462 is no longer in engagement with the camming surface 588 of one of the lobes 578 of the three-lobed cam 568. The blocked member 476 is no longer blocked from moving clockwise into a sixty degree void 594 between lobes 578. However, following rotation of the cam 446, the actuator pin 38 continues to engage the follower surface 498 of the follower arm 458 of the latch 432 overcoming the attempts of the bias spring 40 to return the latch 432 completely to the unlatched position.

Therefore, after the cam 446 rotates sixty degrees the lever 462 moves slightly forward to its latched and non-blocked position. During movement of the lever 462 to its latched but non-blocked position, the engaging wall 524 of latching arm 460 moves forward and out of engagement with the striker plate or inside surface 28 of the oven door 12. Only when the door 12 is pulled open and the door springs (not shown) are no longer forcing the oven door 12 against the actuator pin 38 does the latch bias spring 440 induce full clockwise rotation of the latch 432 causing the latch 432 and the lever 462 to return to the unlatched position.

The manner of operation of the oven lock mechanism 430 can be better understood by understanding the configuration and interaction of the various components of the oven lock mechanism 430. These components are designed and configured to facilitate the above described manner of operation of the oven lock mechanism 430. As previously mentioned, the oven lock mechanism 30 includes a latch 432, a rotary push rod 454, a latch pivot pin 436, an actuator pin 38, a latch bias spring 440, a motor and gear box 44, a cam 446, a cam-actuated switch 448, a lever actuated switch 450, a front mounting plate 451 and a rear mounting plate 453, a lock out lever 462 and a lock out lever pivot pin 456.

The latch 432 is configured to facilitate being rotated into a latched position by closure of the oven door 12 and being blocked in that position. As shown, for example, generally in FIGS. 28–32, and more particularly in FIGS. 33–34, latch 432 includes a follower arm 458 and a latching arm 460 both extending generally radially from a central body 464 formed to include a pivot pin-mounting hole 466. Pivot mounting hole 466 is sized to receive the shaft of the pivot pin 436 therein. The latch 432, except for a spring anchor finger 528, is substantially planar having a top surface 472 and a bottom surface 474 The latch 432 is configured to pivot about a pivot axis 616 extending through the pivot pin 436. The latch 432 is mounted for pivotal movement relative to the front mounting plate 451. Generally, the latch 432 is mounted so that it is positioned above portions of the front mounting plate 451. During formation of the front mounting plate 451, certain bosses and riding surfaces are formed on the front mounting plate 451. The bosses and riding surfaces aid in reducing friction between the latch 432 and the front mounting plate 451 by reducing the surface area that is in engagement between the two. The bosses and riding surfaces also tend to aid in maintaining the substantially parallel relationship between the bottom surface 474 of the latch 432 and the upper surface of the front mounting plate 451.

The follower arm 458 of the latch 432 includes an axis 492, a front surface 494, a rear surface 496 and an arcuate follower surface 498. The axis 492 of the follower arm 458 extends radially outwardly from the pivot pin-mounting hole 466 through the push rod-mounting hole 469. The rear surface 496 of the follower arm 458 is generally parallel to the axis 492. The front surface 494 of the follower arm 458 is formed to include the convex arcuate follower surface 498. The convex arcuate follower surface 498 extends forwardly from front surface 494 of the follower arm 458. In the illustrated embodiment, follower surface 498 has a radius of curvature centered on the rear surface 496 of the follower arm 458. Arcuate follower surface 498 provides a surface for cam surface 262 of actuator pin 38 to bear against. Thus, inward rectilinear movement of the actuator pin 38 induces the follower arm 458 to be urged to rotate counter-clockwise about pivot axis 616.

The latching arm 460 of the latch 432 includes an axis 514, an outside wall 516, an inside wall 518, and a latching member 520. The axis 514 of latching arm 460 extends radially from the pivot pin-mounting hole 466. In the illustrated embodiment, the axis 514 of the latching arm 62 forms an angle 493 with respect to the axis 492 of the follower arm 458. In the illustrated embodiment, the angle 493 between the axis 514 of the latch arm 460 and the axis 492 of the follower arm 458 is seventy-five degrees.

Figure 33:
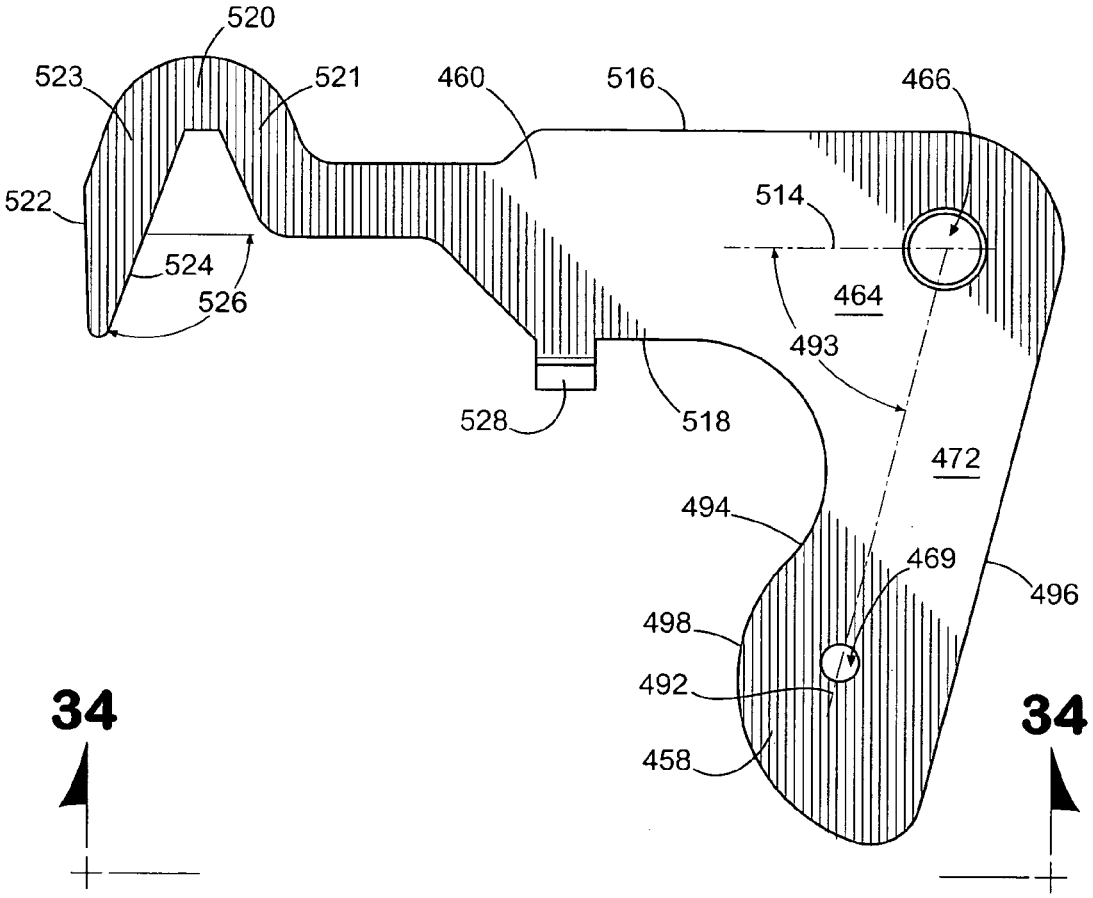
FIG. 33 is a top plan view of the latch of FIG. 28.
Figure 34:
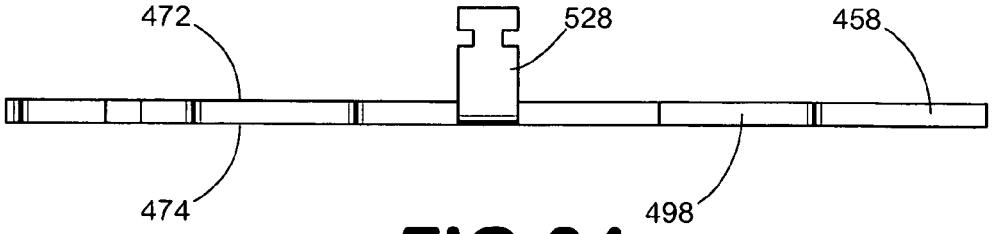
FIG. 34 is a side elevation view of the latch taken along line 34—34 of FIG. 33.

As shown, for example, in FIG. 33, adjacent to the main body 464, the inside wall 516 and outside wall 518 are both parallel to the axis 514 of the latching arm 460. The latching arm 460 tapers as it extends forward resulting in the outside wall 516 and inside wall 518 forming angles with the axis 514. Eventually the outside wall 516 and the inside wall 518 of the latching arm 460 again extend parallel to the axis 514 in a narrow neck to which the latching member 520 is coupled. The narrow neck is offset outwardly from the axis 514 but is parallel thereto. The latching member 520 includes an outwardly and forwardly extending leg 521 and an inwardly and forwardly extending leg 523. The leg 523 includes an end wall 522 and an engaging wall 524. The engaging wall 524 extends inwardly and slightly forwardly from inside wall 518 at an angle 526. In the illustrated embodiment, angle 526 is one hundred twelve degrees.

Near the taper point of the latching arm 460 of the latch 432, a latch bias spring anchor finger 528 extends upwardly from the upper surface 472 of inside wall 518 of the latching arm 560. Spring anchor finger 528 is formed to include notches therein for receipt of the latch end 437 of the latch bias spring 440. Latch bias spring 440 biases the latch 432 toward the unlatched position.

Figure 35:
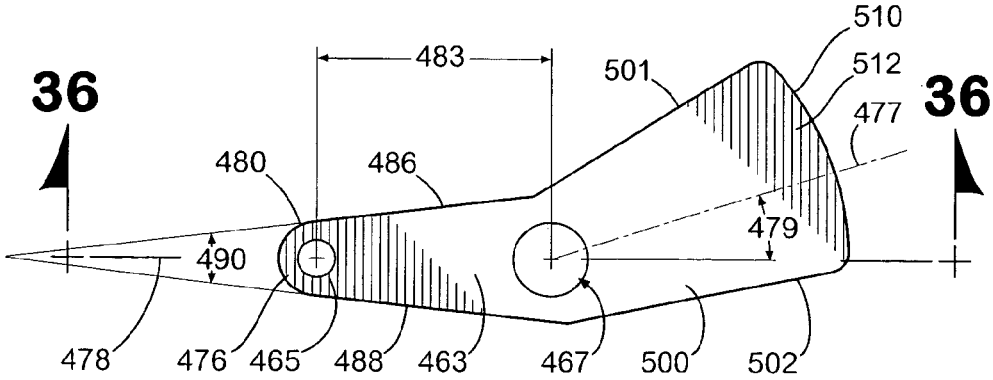
FIG. 35 is a top plan view of the lever of FIG. 28.
Figure 36:
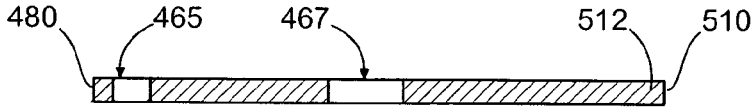
FIG. 36 is a sectional view of the lever taken along line 36—36 of FIG. 35.

As shown, for example, in FIGS. 35–36, the lock-out lever 462 is formed to 5 include a blockable portion 463 and a switch actuator portion 500. A blocked member 476 is formed on the end of the blockable portion 463. The blockable portion 463 extends radially from the mounting hole 467. The blockable portion 463 includes an axis 478 extending radially outwardly from the mounting hole 467 through the push rod-mounting hole 465. The push rod-mounting hole 465 is formed in the blockable portion 10 463 centered on the axis 478 with its focus displaced from the pivot pin-mounting hole 467 by a distance 483. The distance 483 is equal to the radius of curvature 772 of the center of the rod-receiving slot 770 in the rear mounting plate 453. When assembled, the upwardly extending rear arm 780 of the push rod 454 extends through the push rod slot 770 in the rear mounting plate 453 and is received in the push rod-receiving hole 465 of 1 5 the lever 462, as shown, for example, in FIGS. 28–32.

Blockable portion 463 includes front wall 486 and rear wall 488 extending inwardly with respect to the axis 478 forming a tapered arm. The blocked member 476 includes a rounded follower surface 480 at its lateral extreme surface. The front and rear walls 486, 488 meet at the rounded follower surface 480 to form and angle 490 20 therebetween, as shown, for example, in FIG. 35. In the illustrated embodiment, the angle 490 between the front wall 486 and the rear wall 488 of the blockable portion 463 is approximately fourteen degrees. The shape of the blockable portion 463 permits the blocked member 476 to extend into a void 594 between two lobes 578 of the three lobed cam 568 of the cam 446 when the lever 462 is in an unlatched position, as shown, for example, in FIG. 28.

The switch actuator portion 500 extends radially outwardly from the pivot pin-mounting hole 467. The switch actuator portion 500 includes an axis 477 which forms an angle 479 with the axis 478 of the blocker portion 463. The switch actuator surface 5 10 on the outer end 512 of the switch actuator portion 500 is curved with a radius of curvature centered at the focus (the location of pivot axis 617) of the pivot pin-mounting hole 467. The switch actuator portion 500 includes a front wall 501 and a rear wall 503. The corners formed by the switch actuator surface 510 and the front and rear walls 501, 503 are radiused to facilitate smooth engagement and disengagement with the contact button 449 of the lever-actuated switch 450. Thus, so long as the switch actuator surface 510 remains in contact with the contact button 449 of the lever-actuated switch 450 during rotation of the latch 432 and the lever 462, the switch actuator surface 510 applies a constant force to the contact button 449. When the oven door 12 is closed, as shown, for example, in FIG. 29, the lever 462 is rotated sufficiently so that switch actuator surface 510 engages the contact button 449.

Figure 30:
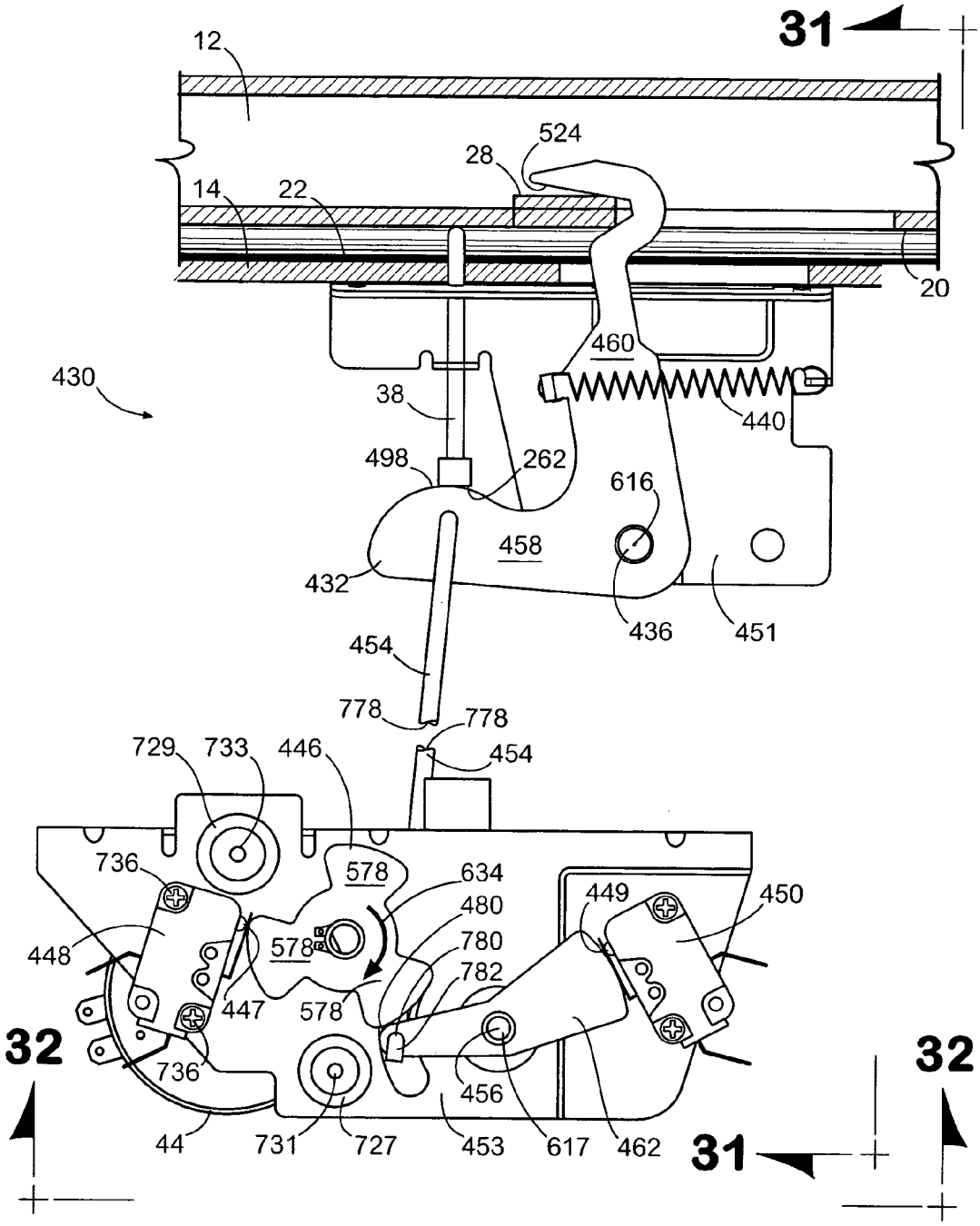
FIG. 30 is a plan view similar to FIG. 28 with the latch of the oven lock mechanism having been blocked in the latched position against returning to the unlatched position and the latch having been urged rearwardly against the striker plate of the oven door to snug the oven door to the frame.
Figure 31:
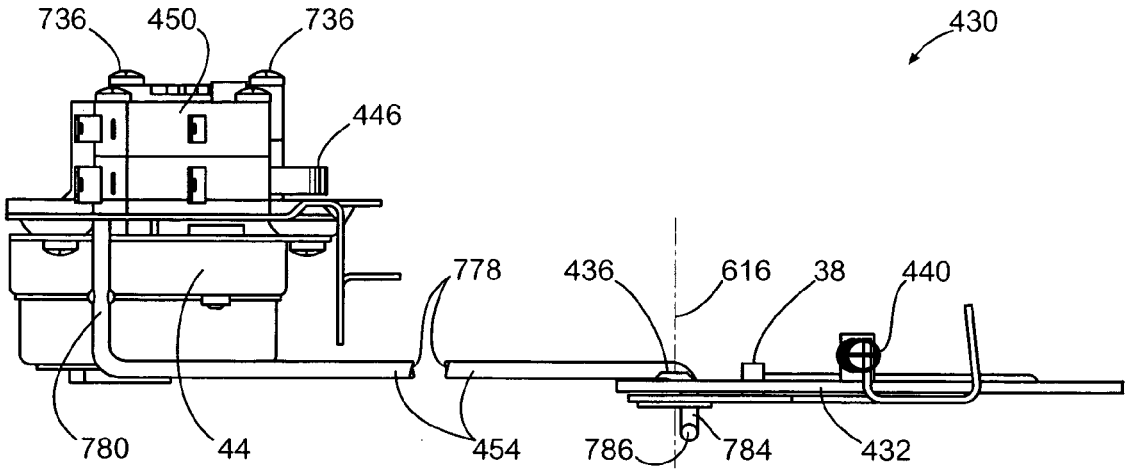
FIG. 31 is a side elevation view taken along line 31—31 of FIG. 30 with the oven portions removed of the second embodiment of the oven lock mechanism.
Figure 32:
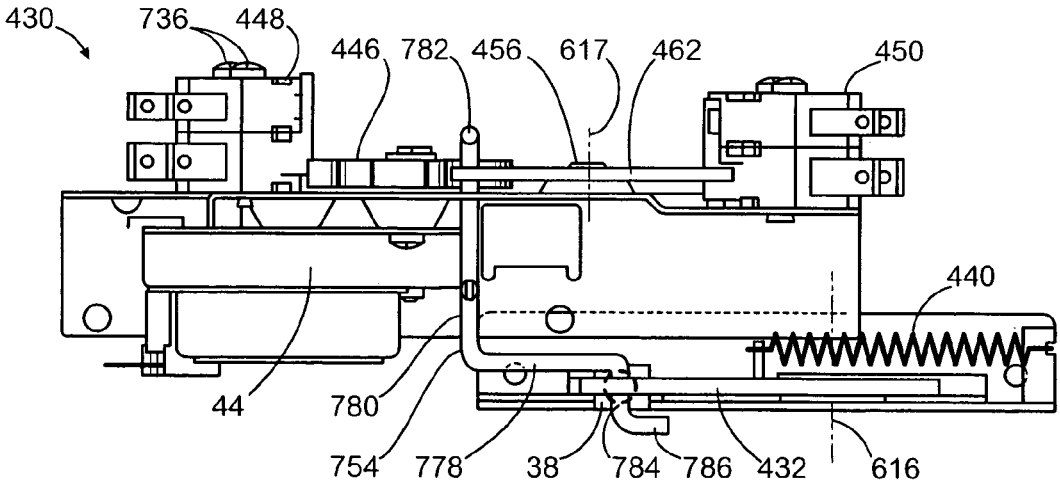
FIG. 32 is a rear elevation view taken along line 32—32 of FIG. 30 with the oven portions removed of the second embodiment of the oven lock mechanism.

As shown for example, in FIG. 30, the cam 446 rotates in the direction of the arrow 634 which, from the top of the oven 10, is clockwise. Therefore in describing components of the cam 446, the terms "leading" and "trailing" will be used to describe various components with the understanding that "leading" refers to a component that is clockwise with respect to the "trailing" component.

Figure 37:
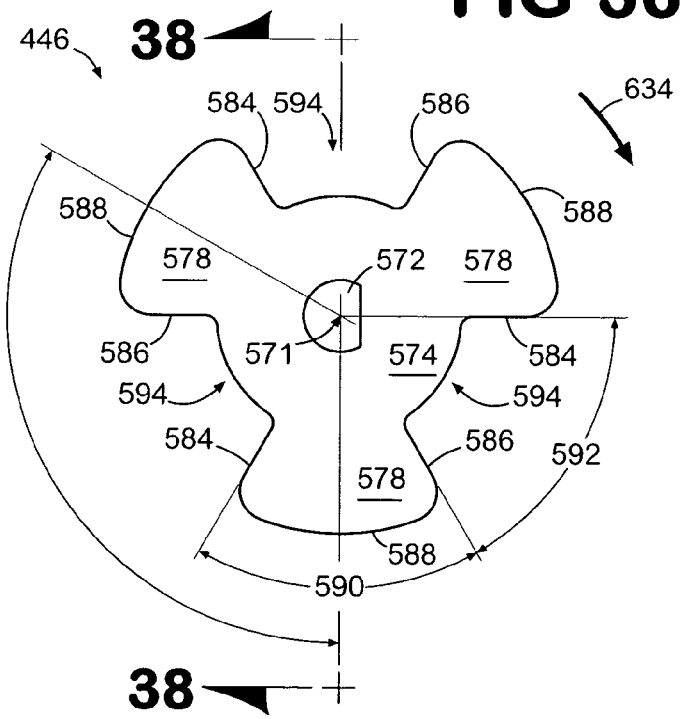
FIG. 37 is a top plan view of the cam of FIG. 28.
Figure 38:
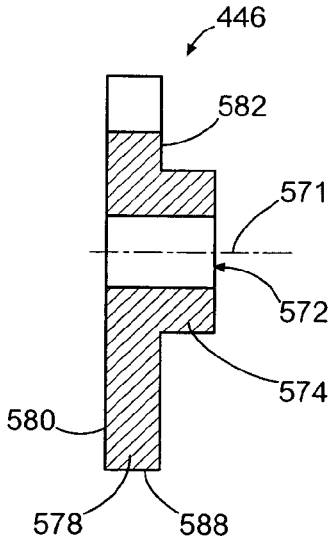
FIG. 38 is a sectional view of the cam taken along line 38—38 of FIG. 37.
Figure 39:
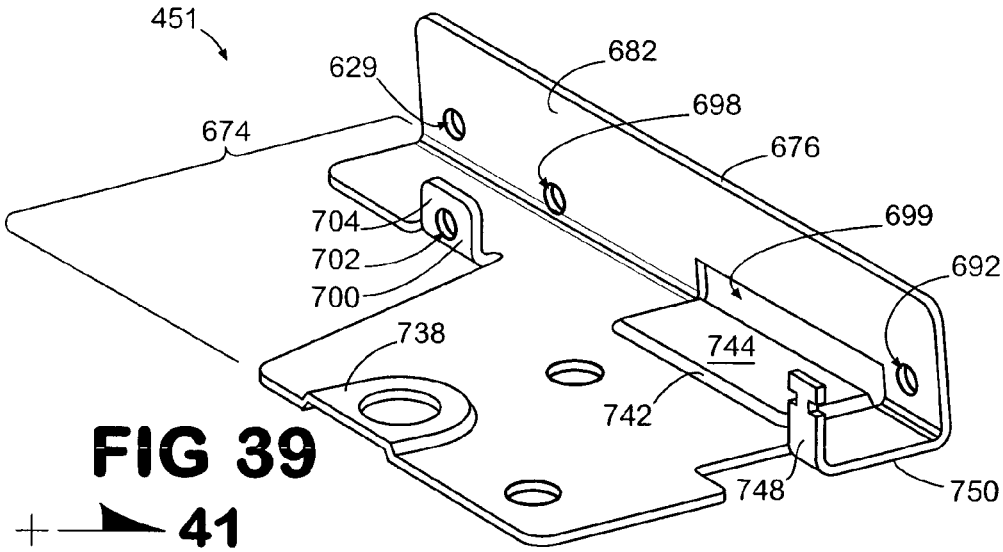
FIG. 39 is a perspective view of the front mounting plate of FIG. 28.
Figure 40:
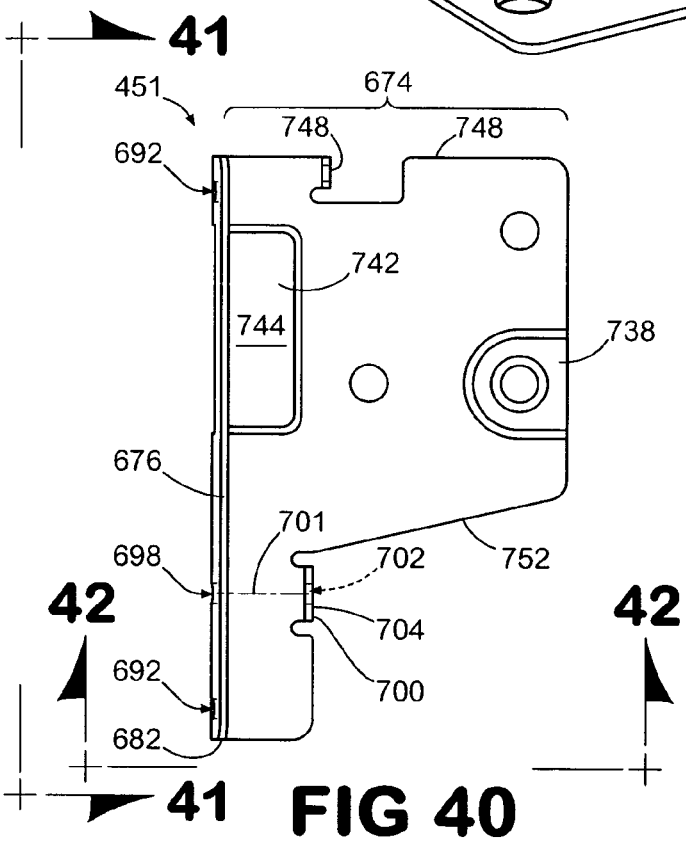
FIG. 40 is a top plan view of the front mounting plate of FIG. 39.
Figure 41:
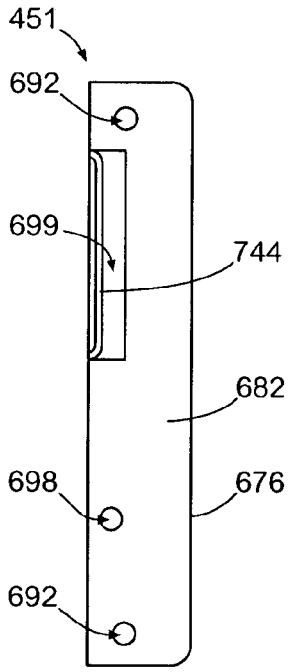
FIG. 41 is a front elevation view of the front mounting plate taken along line 41—41 of FIG. 40.
Figure 42:
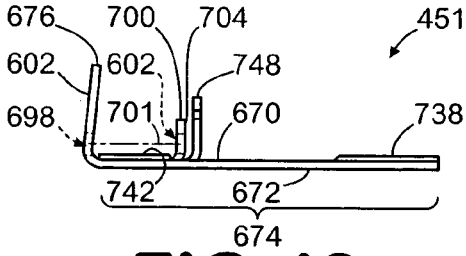
FIG. 42 is a side elevation view of the front mounting plate taken along line 42—42 of FIG. 40.
Figure 43:
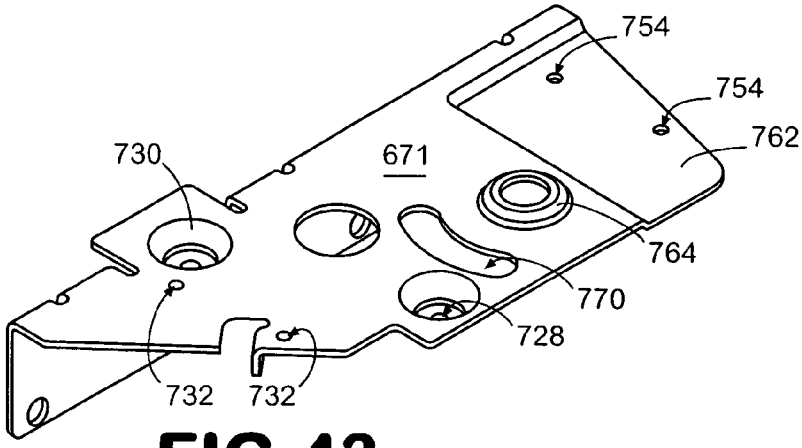
FIG. 43 is a perspective view of the rear mounting plate of FIG. 28.
Figure 45:
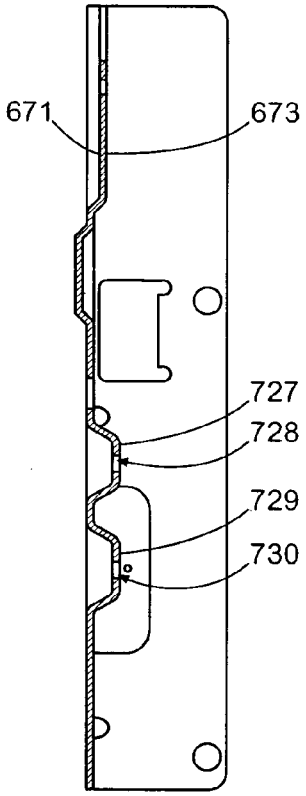
FIG. 45 is a sectional view of the rear mounting plate taken along line 45—45 of FIG. 44.
Figure 44:
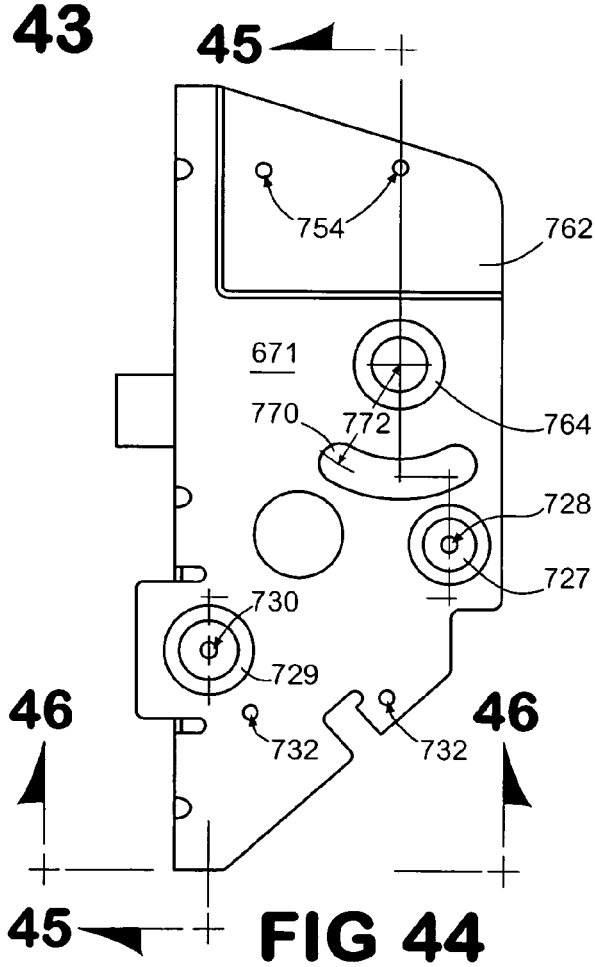
FIG. 44 is a top plan view of the rear mounting plate of FIG. 43.
Figure 46:
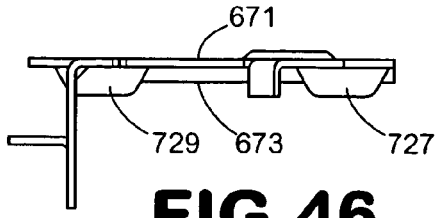
FIG. 46 is a side elevation view of the rear mounting plate taken along line 46—46 of FIG. 44.

As shown, for example, in FIGS. 37–38, the cam 446 includes a three lobed cam 568 formed symmetrically around an axis 571 extending through the D-shaped shaft-mounting bore 572 extending through an otherwise generally cylindrical body 574. The D-shaped motor driven shaft 250 is received in D-shaped mounting bore 572 to couple the cam 446 to the shaft 250.

As shown, for example, in FIG. 37, the three lobed cam 568 includes three indistinguishable lobes 578 extending radially from the axis 571 of the generally cylindrical body 574 of the cam 446. Each lobe 578 includes a top surface 580, a bottom surface 582, a leading side wall 584, a trailing side wall 586 and a camming surface 588. Camming surface 588 extends between the leading and the trailing side walls 584, 586.

The leading side walls 584 and the trailing side walls 586 extend radially from the generally cylindrical body 574. The leading side wall 584 and trailing side wall 586 of each lobe 578 form an angle 590 of sixty degrees with respect to each other. Additionally, the trailing side wall 586 of each lobe 578 forms an angle 592 of sixty degrees with the leading side wall 584 of its trailing lobe 578, as shown, for example, in FIG. 37. Thus, the trailing side wall 586 of each lobe 578 and the leading side wall 584 of its trailing lobe 578 define a sixty degree void 594. Also the leading side wall 584 of a cam 578 and the trailing side wall 586 of its trailing cam 578 are diametrically opposed.

The camming surface 588 of each lobe 578 is generally arcuate shaped having a radius of curvature centered at the axis 571 of the mounting bore 572. However, at the junctures of the camming surface 588 with the leading side wall 584 and the trailing side wall 586, the camming surface 588 and the side walls 584, 586 are radiused. The radius at the junctures of the camming surface 588 and the side walls 584, 586 facilitate smooth engagement and disengagement of the camming surface 588 with the follower surface 480 of the blocked member 476 of the lever 462 during rotation of the cam 446.

As shown, for example, in FIGS. 28–32, the rotary push rod 454 includes a straight section 778, a rear upwardly extending arm 780, a rear offset arm 782, a front downwardly-extending arm 784 and a front offset arm 786. The straight section 778 spans the distance between the front mounting plate 451 and rear mounting plate 453. The length of the straight section 778 is selected based upon the depth of the oven 10 and the lateral offset of the front and rear mounting plates 451, 453. The rotary push rod 454 couples the latch 432 and the lever 462 together so that movement of one component is transferred to the other. The upwardly extending rear arm 780 extends through the arcuate slot 770 in the rear mounting plate 453 and the rod-receiving hole 465 in the lever 462. The rear offset arm 782 engages the top surface of the lever 462 to prevent rod 454 from falling out of lever 462. The downwardly-extending front arm 784 extends through the rod-receiving hole 469 in the latch 432. The front offset arm 786 engages the bottom surface 474 of the latch 432 to prevent rod 454 from coming out of the latch 432.

The illustrated mounting plates 451, 453 are each stamped and formed from a single sheet of metal such as nickel electroplated bright nickel. Both mounting plates 451, 453 include essentially two regions, a substantially planar component mounting portion and an offset oven mounting portion.

The oven mounting portion 676 of the front mounting plate 451 includes a lip 682. The lip 682 is coupled to and extends upwardly from the front edge of the component mounting portion 674. The upwardly extending lip 682 is formed to include two mounting holes 692, a shaft-mounting aperture 698 and a latch slot 699. Fasteners (not shown) extend through the two mounting holes 692 to mount the front mounting plate 51 to the oven frame 14. The shaft 258 of the actuator pin 38 is received in the shaft-receiving aperture 698 for reciprocal movement forwardly and rearwardly therein.

The latch member 520 of the latching arm 460 of the latch 432 extends through slot 699 and rotates clockwise and counterclockwise therein between the upwardly extending end walls of the slot 699.

The component mounting portion 674 is substantially planar. A plurality of brackets, flanges, legs and fingers extend from the top surface 670 and the bottom surface 672 of the component mounting portion 674 to facilitate mounting the latch 432, latch spring 440, actuator pin 38 and one end of the rotary push rod 454 to the front mounting plate 451.

The front mounting plate 451 is formed to facilitate mounting the actuator pin 38 thereto for reciprocal forward and rearward movement. A rear actuator-mounting bracket 700 extends upwardly from the top surface 670 of the component-mounting portion 674. Rear actuator-mounting bracket 700 is formed to include a shaft-receiving aperture 702 extending between its front surface and rear surface. As shown, for example by line 701 in FIGS. 40 and 42, the shaft-receiving apertures 698, 702 are aligned to permit the shaft 258 of the actuator pin 38 to reciprocate forwardly and rearwardly therethrough.

When the actuator pin 38 is mounted to the front mounting plate 451, the shaft 258 of the actuator pin 38 is received in the shaft-receiving apertures 298, 302. The rear surface 704 of the rear actuator-mounting bracket 700 engages the annular wall 266 of the actuator pin head 256 to act as a stop against forward reciprocal movement.

The front mounting plate 451 is configured to facilitate mounting the latch 432 so that it can assume a non-latching, latching and pulled-in position. The latch 432 is mounted to pivot about a fixed pivot axis 616 relative to the front mounting plate 451. To maintain portions of the latch 432 substantially parallel to the mounting plate 451, portions of the latch 432 engage various surfaces on the mounting plate 451. Thus, the front mounting plate 451 is formed to include a main body mesa 738 extending upwardly from the top surface 670 of the mounting plate 451, as shown, for example, in FIGS. 39–42. The front mounting plate 451 is also formed to include a latch arm riding mesa 742 extending upwardly from the top surface 670 of the mounting plate 451 adjacent to the latch slot 699. The latch arm riding mesa 742 includes a riding surface 744.

When the latch 432 is mounted to and supported pivotally above the mounting plate 451, the bottom surface of the follower arm 458 of the latch 432 rides on the main body mesa 738 and the bottom surface of the latch arm 460 rides on the latch arm riding surface 744. Rotation of the latch 432 in a counter-clockwise direction (as seen from above) is limited by the inner wall 518 of the latch arm 60 coming into engagement with the inner wall of the slot 699. Similarly, clockwise rotation of the latch 432 is limited by the outer wall 518 of the latching arm 460 coming in contact with the outer wall of the slot 699. The mesas 738, 742 on the front mounting plate 451 are formed to ensure that the latch 432 is in a position in which the follower surface 498 of follower arm 458 is positioned to engage the cam surface 262 of the head 256 of actuator pin 38.

The front mounting plate 451 includes a latch spring anchor finger 748 extending upwardly from the top surface 670 of one side 750 of the mounting plate. The mounting plate end 439 of latch bias spring 440 is coupled to the latch spring anchor finger 748 and the latch end 437 of the spring 440 is coupled to the bias spring anchor finger 528 on the latching arm 460 of the latch 432. The spring 440 biases the latch 432 toward the unlatched position.

The opposite side wall 752 of the front mounting plate 451 is formed inwardly of the actuator-mounting bracket 700. Thus, the portion of the follower arm 458 of the latch 432 formed to include the push rod-receiving hole 469 is not located above the front mounting plate 451. This facilitates inserting the front downwardly-extending leg 784 of the rod 454 through the rod-receiving hole 469 in the latch 432 without the lateral offset leg 786 encountering interference from the mounting plate 451.

The rear mounting plate 453 is configured to facilitate mounting the motor and gearbox 44 and the cam 446 in a fixed position relative to the rear mounting plate 453. The motor and gearbox 44 and the cam 446 are mounted in a position so that the three lobed cam 568 interacts with the blocked member 476 of the lever 462 and a contact button 447 of the cam-actuated switch 448. Thus, the rear mounting plate 453 includes a motor shaft-receiving hole 726 sized to permit the motor driven shaft 250 and the generally cylindrical body 574 of the cam 446 to extend therethrough and rotate therein without engaging the walls of the hole 726.

Two frusto-conical motor mount bosses 727, 729 extend downwardly from the bottom surface 673 of the rear mounting plate 653. Motor-mounting holes 728, 730 extend through the flat bottom surfaces of each motor mount boss 727, 729, respectively, of the rear mounting plate 453. Fasteners 731, 733 are received in motor-mounting holes 728, 730, respectively, in rear mounting plate 453 and motor-mounting holes 246, 248, respectively, in the motor and gearbox 44 to mount the motor and gear box 44 to the rear mounting plate 453. Motor-mounting holes 728, 730 are disposed on the rear mounting plate 453 to facilitate mounting motor and gearbox 44 to the rear mounting plate 453. When the fastener 731 extends through the mounting holes 728, 246 and the fastener 733 extends through the mounting holes 248, 730, the motor driven shaft 250 is disposed in the center of the shaft-receiving hole 726. The cam 446 is mounted on the motor driven shaft 250 to interact with the blocked member 476 of the lever 462.

The rear mounting plate 453 is configured to facilitate mounting the cam-actuated switch 448 on the mounting plate 453 at a location in which the cam 446 engages the contact button 447 of the switch 448. The mounting plate 453 is formed to include two switch mounting holes 732. Fasteners 736 (FIG. 28–32) extend through the switch mounting holes 732 and mounting holes (obscured by fasteners 736) on the cam-actuated switch 448 to secure the switch 448 to the mounting plate 453. The mounting holes 732 are positioned and configured to place the contact button 447 of the cam-actuated switch 448 where it can be actuated by any of the lobes 578 of the three lobed cam 568 during rotation of the cam 446.

The rear mounting plate 453 is also formed to ensure that the blocked member 476 of the lever 462 is positioned to be engaged by a lobe 578 of the three-lobed cam 568 when the lever 462 and the latch 432 are in the latched position. To that end, rear mounting plate 453 is formed to include an upwardly-extending lever mesa 764 in which the lever mounting pivot pin hole 467 is formed. Since the cam 446 is mounted so that the bottom surfaces 582 of the three lobed cam 568 are displaced from the top surface 671 of the rear mounting plate 453, the horizontal offset provided by the lever mesa 764 positions the following surface 480 of the lever in a position to be engaged by the camming surfaces 588 of the cam 446. Thus, the blocked member 476 is positioned to be selectively blocked and non-blocked by one of the three lobes 578 of the cam 446.

The rear mounting plate 453 is formed to facilitate actuation of the lever actuated switch by the actuator surface 510 of the lever 462. The actuator surface 510 selectively engages and actuates the contact button 449 of the lever-actuated switch 450. Two mounting holes 754 are formed in a depression 762 for mounting switch 450 to the top surface 671 of the mounting plate 52. Fasteners 756 extend through the mounting holes 754 and mounting holes (obscured by fasteners 756) on the switch 450 to mount the switch 540 to the mounting plate 453.

The mounting plate 453 is formed to include an arcuate slot 770 through which the rear upwardly extending arm 780 of the rotary push rod 454 extends to be received in the push rod-receiving hole 465 of the lever 462. The arcuate slot 770 is sufficiently wide to receive the upwardly extending arm 780 of the push rod 454 therethrough without the push rod 454 engaging the walls of the slot 770. The walls of the slot 770 are formed concentrically about an arc having a radius of curvature 772 equal to the distance 483 between the centers of the pivot pin-mounting hole 467 and the rod-receiving hole 465 in the lever 462.

The disclosed oven lock mechanisms 30, 430 provide mechanical schemes to swing or pivot the entire latch 32, 432 after it is placed in a latched position relative to the oven door striker 28. In oven lock mechanism 30 this swinging action is accomplished by the latch 32 being mounted to rotate about a pivot point 216 fixed relative to the torque arm 34 that is movable relative to the mounting plate 52. In the oven lock mechanism 30, the torque arm 34 is moved in response to movement of a triangular-shaped cam 170 that is integrally mounted to the underside of the blocker which is a camming surface 188 of a three lobed cam 168. The cams 168, 170 are rotated by the motor in response to the oven being placed in a self-cleaning mode of operation, and thereafter when a cleaning time period has expired. In oven lock mechanism 430 this swinging action is accomplished by the latch 32 being mounted to rotate about a pivot point 616 fixed relative to a front mounting plate 451 and being coupled to a lever 462 mounted to pivot about a pivot point 617 fixed relative to a rear mounting plate 453. The latch 432 and lever are coupled by a rod 454. Rotation of the latch 432 into the latched position causes the lever to be moved into a latched but non-blocked position. Rotation of the blocker cam 168 into the blocked position urges additional rotation of the lever 462 causing additional rotation of the latch 432.

At the end of the self-cleaning cycle, a signal is sent to the motor and the cams 46, 446 are rotated to a non-blocked position. The oven door 12 can then be opened. As the door 12 is pulled open, return springs drive the latch 32, 432 to an unlatched position.

Although the invention has been described in detail with reference to a certain preferred embodiment, variations and modifications exist within the scope and spirit of the present invention as described and defined in the following claims.

The invention claimed is:

1. An oven lock mechanism for use with an oven having a door and a frame surrounding a cooking chamber having an opening selectively closed by engagement of the door with the frame, the lock mechanism comprising:

a mounting plate mounted to the frame, the mounting plate including a front mounting plate portion coupled to a front of the frame adjacent the cooking compartment opening and a rear mounting plate portion coupled to a rear of the oven;

a latch mounted to the front mounting plate portion for movement about a pivot axis and rotatable about the pivot axis between an unlatched and latched position, the latch including a follower surface offset from the pivot axis;

an actuator pin movably supported by the front mounting plate portion, the actuator pin having an outer end extending beyond the front mounting plate portion for engaging the oven door upon closure and a cam end engaging the follower surface for rotating the latch into the latched position wherein the door is adapted to be captured by the latch;

a blocker mounted to the rear mounting plate portion, the blocker selectably movable into a blocking position when the latch is in a latched position for interfering with the rotation of the latch such that the latch is locked into the latched position for locking the oven door in a closed position a motor mounted to the rear mounting plate portion, the motor moving the blocker and wherein movement of the blocker into the blocking position induces additional movement of the latch to pull the oven door closer to the frame; and a lever mounted to the rear mounting plate portion for movement relative thereto and a link coupling the lever to the latch.

2. The device of claim 1 wherein the blocker is rotated sixty degrees or less to induce the additional movement of the latch to pull the oven door closer to the frame.

3. The device of claim 1 wherein the blocker engages the lever and induces movement of the lever to induce the additional movement of the latch to pull the oven door closer to the frame.

4. The device of claim 3 and further comprising a switch arranged to be selectively actuated by the lever and controlling a motor drive circuit.

5. An oven lock mechanism for use with a self-cleaning oven having a door for selectively closing an opening of a cooking compartment surrounded by a frame and a compressible seal, the oven lock mechanism comprising:

a mounting plate coupled to the frame near the oven compartment opening;

a latch pivotably mounted to the mounting plate about a pivot axis and rotatable between an unlatched and latched position, the latch including a follower surface offset from the pivot axis;

a blockable member mounted for movement relative to the mounting plate the blockable member being coupled to the latch so that when movement of the blockable member is blocked, movement of the latch from the latched to the unlatched position is inhibited;

an actuator pin movably supported by the mounting plate, the actuator pin having an outer end extending beyond the mounting plate for engaging the oven door upon closure and a cam end engaging the follower surface for rotating the latch into the latched position wherein the door is adapted to be captured by the latch; and a blocker mounted for movement relative to the mounting plate to selectively block and unblock the blockable member; and a motor coupled to the mounting plate, the motor when actuated moving the blocker and wherein movement of the blocker induces additional movement of the latch from the latched position to a position wherein the oven door engages and compresses the seal.

6. The device of claim 5 wherein the motor when actuated moves the blocker into engagement with the blockable member to induce the additional movement of the latch from the latched position to the position wherein the oven door engages and compresses the seal.

7. The device of claim 5 and further comprising an arm mounted for movement relative to the mounting plate, a dual cam including the blocker and an arm engaging cam and wherein the latch is mounted to the arm and when actuated the motor drives the arm engaging cam to move the arm and induce the additional movement of the latch from the latched position to the position wherein the oven door engages and compresses the seal.

8. An oven lock mechanism for use with an oven having a door and a frame surrounding a cooking chamber having an opening selectively closed by engagement of the door with the frame, the lock mechanism comprising:

a mounting plate mounted to the frame, the mounting plate includes a front mounting plate portion coupled to a front of the frame adjacent the cooking compartment opening and a rear mounting plate portion coupled to a rear of the oven;

a latch mounted to the front mounting plate portion for movement about a pivot axis extending through the latch and pivotable about the pivot axis between an unlatched and latched position, the latch including a follower surface offset from the pivot axis;

an actuator pin supported on the front mounting plate portion for movement upon closure of the oven door, the actuator pin having a cam end engaging the follower surface of the latch upon closure of the oven door for urging the latch to pivot into the latched position wherein the door is adapted to be captured by the latch;

a blocker mounted on the rear mounting plate portion and being selectably movable into a blocking position when the latch is in a latched position for interfering with the rotation of the latch such that the latch is locked into the latched position for locking the oven door in a closed position; and a motor mounted to the rear mounting plate portion, the motor moving the blocker and wherein movement of the blocker into the blocking position induces additional movement of the latch to pull the oven door closer to the frame; and a lever mounted to the rear mounting plate portion for movement relative thereto and a link coupling the lever to the latch.

9. The device of claim 8 wherein the blocker is rotated sixty degrees or less to induce the additional movement of the latch to pull the oven door closer to the frame.

10. The device of claim 8 wherein the blocker engages the lever and induces movement of the lever to induce the additional movement of the latch to pull the oven door closer to the frame.

11. The device of claim 8 wherein the blocker engages the lever and induces movement of the lever to induce the additional movement of the latch to pull the oven door closer to the frame.

12. The device of claim 11 and further comprising a switch arranged to be selectively actuated by the lever and controlling a motor drive circuit.

* * * * *